US011764012B2

(12) United States Patent
Imazawa et al.

(10) Patent No.: US 11,764,012 B2
(45) Date of Patent: Sep. 19, 2023

(54) GAS CIRCUIT BREAKER

(71) Applicants: Kabushiki Kaisha Toshiba, Tokyo (JP); Toshiba Energy Systems & Solutions Corporation, Kanagawa (JP)

(72) Inventors: Yuko Imazawa, Kanagawa (JP); Tomoyuki Yoshino, Kanagawa (JP); Toshiyuki Uchii, Kanagawa (JP); Takato Ishii, Kanagawa (JP); Akira Shimamura, Kanagawa (JP); Tomohiro Hasegawa, Kanagawa (JP)

(73) Assignees: Kabushiki Kaisha Toshiba, Tokyo (JP); Toshiba Energy Systems & Solutions Corporation, Kawasaki (JP)

( * ) Notice: Subject to any disclaimer, the term of this patent is extended or adjusted under 35 U.S.C. 154(b) by 116 days.

(21) Appl. No.: 17/425,934

(22) PCT Filed: Mar. 19, 2019

(86) PCT No.: PCT/JP2019/011501

§ 371 (c)(1),
(2) Date: Jul. 26, 2021

(87) PCT Pub. No.: WO2020/188754

PCT Pub. Date: Sep. 24, 2020

(65) Prior Publication Data

US 2022/0319787 A1 Oct. 6, 2022

(51) Int. Cl.
*H01H 33/70* (2006.01)
*H01H 33/91* (2006.01)

(52) U.S. Cl.
CPC ..... *H01H 33/91* (2013.01); *H01H 33/7023* (2013.01)

(58) Field of Classification Search
CPC ..... H01H 33/91; H01H 33/7023; H01H 2033/908

(Continued)

(56) References Cited

U.S. PATENT DOCUMENTS 5,898,149 A * 4/1999 Berger ..... H01H 33/905 218/66
6,624,371 B2 * 9/2003 Dufournet ..... H01H 33/901 218/59

(Continued)

FOREIGN PATENT DOCUMENTS

EP 3125265 A1 2/2017
EP 2 837 011 A1 6/2017

(Continued)

OTHER PUBLICATIONS

International Search Report issued by the International Searching Authority in related International Application No. PCT/JP2019/011501, dated May 14, 2019.

*Primary Examiner* — William A Bolton
(74) *Attorney, Agent, or Firm* — Finnegan, Henderson. Farabow, Garrett & Dunner, LLP

(57) ABSTRACT

A gas circuit breaker includes a first arc contactor electrically connected to a first lead-out conductor, a cylindrical guide portion provided on a second lead-out conductor side, a trigger electrode arranged to be movable between the first arc contactor and the guide portion, and igniting an arc along with a movement in a first half of a current breaking action, a compression chamber being formed by a cylinder having an outer wall and an inner wall both formed in a cylindrical shape, and a piston sliding between the outer wall and the inner wall, and an insulation nozzle guiding the arc-extinguishing gas to an arc ignited at the first arc contactor. The insulation nozzle is formed integrally with the inner wall of the cylinder.

10 Claims, 12 Drawing Sheets

(58) Field of Classification Search
USPC ..... 218/43, 46, 53, 57, 59, 61, 63, 72, 116
See application file for complete search history.

(56) References Cited

U.S. PATENT DOCUMENTS

| | | | | |
|---|---|---|---|---|
| 8,115,133 | B2 * | 2/2012 | Uchii | H01H 33/7076 218/63 |
| 2014/0069891 | A1 * | 3/2014 | Otani | H01H 33/7046 218/46 |
| 2015/0021297 | A1 * | 1/2015 | Stoller | H01H 33/7015 218/51 |
| 2015/0194280 | A1 | 7/2015 | Uchii et al. | |
| 2015/0380188 | A1 * | 12/2015 | Sakuyama | H01H 73/18 218/46 |
| 2016/0211097 | A1 | 7/2016 | Uchii et al. | |

FOREIGN PATENT DOCUMENTS

| | | | |
|---|---|---|---|
| JP | S61-14444 | U | 1/1986 |
| JP | S61-82613 | A | 4/1986 |
| JP | S62-10823 | A | 1/1987 |
| JP | 2014-072032 | A | 4/2014 |
| JP | 2015-079635 | A | 4/2015 |
| JP | 2015-185467 | A | 10/2015 |
| WO | WO 2012/011119 | A1 | 1/2012 |
| WO | WO 2013/153112 | A1 | 10/2013 |
| WO | WO 2015/146518 | A1 | 10/2015 |

* cited by examiner

[Closed State]

[First Half of Current Breaking Action]

[Latter Half of Current Breaking Action]

[Closed State]

[First Half of Current Breaking Action]

[Latter Half of Current Breaking Action]

[Closed State]

[First Half of Current Breaking Action]

[First Half of Current Breaking Action]

[Latter Half of Current Breaking Action]

GAS CIRCUIT BREAKER

CROSS-REFERENCE TO RELATED APPLICATIONS

This application is a National Stage Entry of International Application No. PCT/JP2019/011501, filed Mar. 19, 2019 and which is incorporated herein by reference in its entirety.

FIELD

The present disclosure relates to a gas circuit breaker that breaks current in power systems.

BACKGROUND

Gas circuit breakers are used to break current flowing through power supply lines in power systems. The gas circuit breaker is arranged in power supply lines to break current that flows when separating a system in which accident has occurred at the time of system accident.

As the gas circuit breaker described above, a puffer-type gas circuit breaker is widely used. The puffer-type gas circuit breaker has a pair of electrodes arranged oppositely in a sealed container filled with arc-extinguishing gas. This pair of electrodes is driven by a driving device arranged outside the gas circuit breaker to open and close.

When the gas circuit breaker is opened to an opened-state, this pair of electrodes is driven by the driving device arranged outside the gas circuit breaker, and is mechanically separated. However, since a high voltage is applied in the power system, an arc current continues flowing even after the pair of electrodes is mechanically separated. The puffer-type gas circuit breaker breaks this arc current by spraying arc-extinguishing gas to an arc in the sealed container to extinguish the arc.

CITATION LIST

Patent Literature

[Patent Document 1]
Japanese Laid-Open Application No. S61-082631
[Patent Document 2]
Japanese Laid-Open Application No. 2014-72032
[Patent Document 3]
Japanese Laid-Open Application No. 2015-79635

SUMMARY

In the gas circuit breaker described above, the current is broken when a moving electrode moves to be separated from a fixed electrode. An arc generated between the moving electrode and the fixed electrode is extinguished by spraying pressurized arc-extinguishing gas.

The arc-extinguishing gas is pressurized in a current breaking action by a pressurizing mechanism formed by a cylinder and a piston.

However, the arc-extinguishing gas is heated to a high temperature by the arc generated in the current breaking action. The arc-extinguishing gas that has become a high temperature expands, which may make it impossible to obtain sufficient density. In addition, a force of preventing a driving by the pressure of the arc-extinguishing gas that has become a high temperature may become larger than output of a driving device configured to drive the pressurizing mechanism, whereby the arc-extinguishing gas may not be sufficiently pressurized in some cases. The arc-extinguishing gas can achieve high density and high pressure by increasing the output of the driving device configured to drive the pressurizing mechanism and compressing the arc-extinguishing gas more strongly, but the driving device with a large output becomes large. It is not preferable that the driving device becomes large.

An objective of the present disclosure is to provide a gas circuit breaker that can appropriately ensure pressure and density of arc-extinguishing gas to be sprayed to an arc and can more surely maintain electric insulation performance.

A gas circuit breaker of the present disclosure includes the following structure.

(1) A first arc contactor electrically connected to a first lead-out conductor connected to a power system.
(2) A cylindrical guide portion provided at a second lead-out conductor side.
(3) A trigger electrode which is movably arranged between the first arc contactor and the guide portion and which ignites an arc generated between the first arc contactor and the trigger electrode along with a movement in a first half of a current breaking action.
(4) A compression chamber for pressurizing arc-extinguishing gas which includes the following configuration.
(4-1) A cylinder which has an outer wall and an inner wall, each being formed in a cylindrical shape, and which is provided at the guide portion side.
(4-2) A piston which slides between the outer wall and the inner wall in conjunction with the trigger electrode.
(5) An insulation nozzle which guides the arc-extinguishing gas pressurized in the compression chamber to an arc ignited at the first arc contactor.
(6) The insulation nozzle is formed integrally with the inner wall of the cylinder.

DETAILED DESCRIPTION

[First Embodiment]

[1-1. Entire Configuration]

Figure 1:
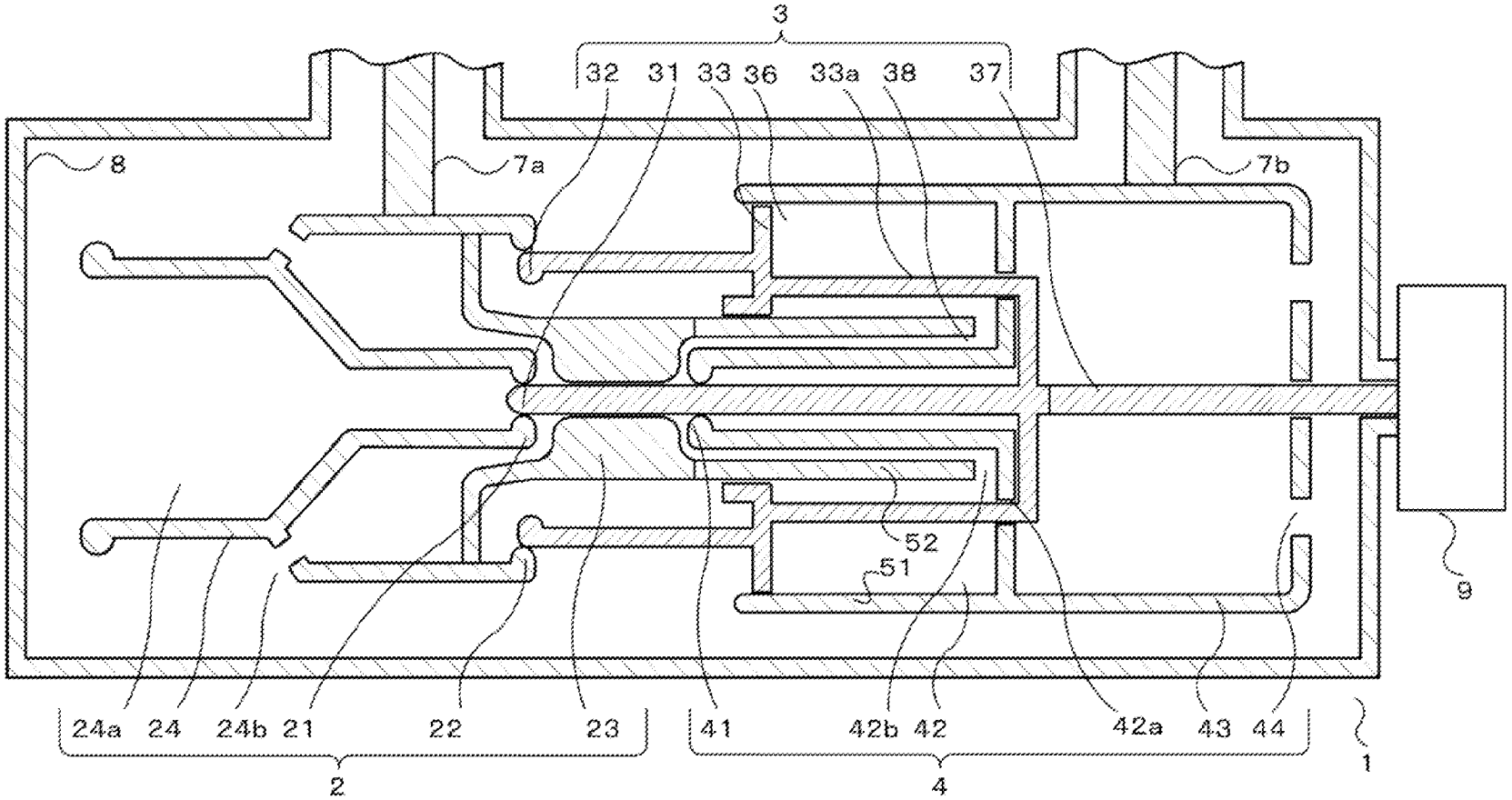
FIG. 1 is a diagram illustrating a closed state of a gas circuit breaker according to a first embodiment.
Figure 2:
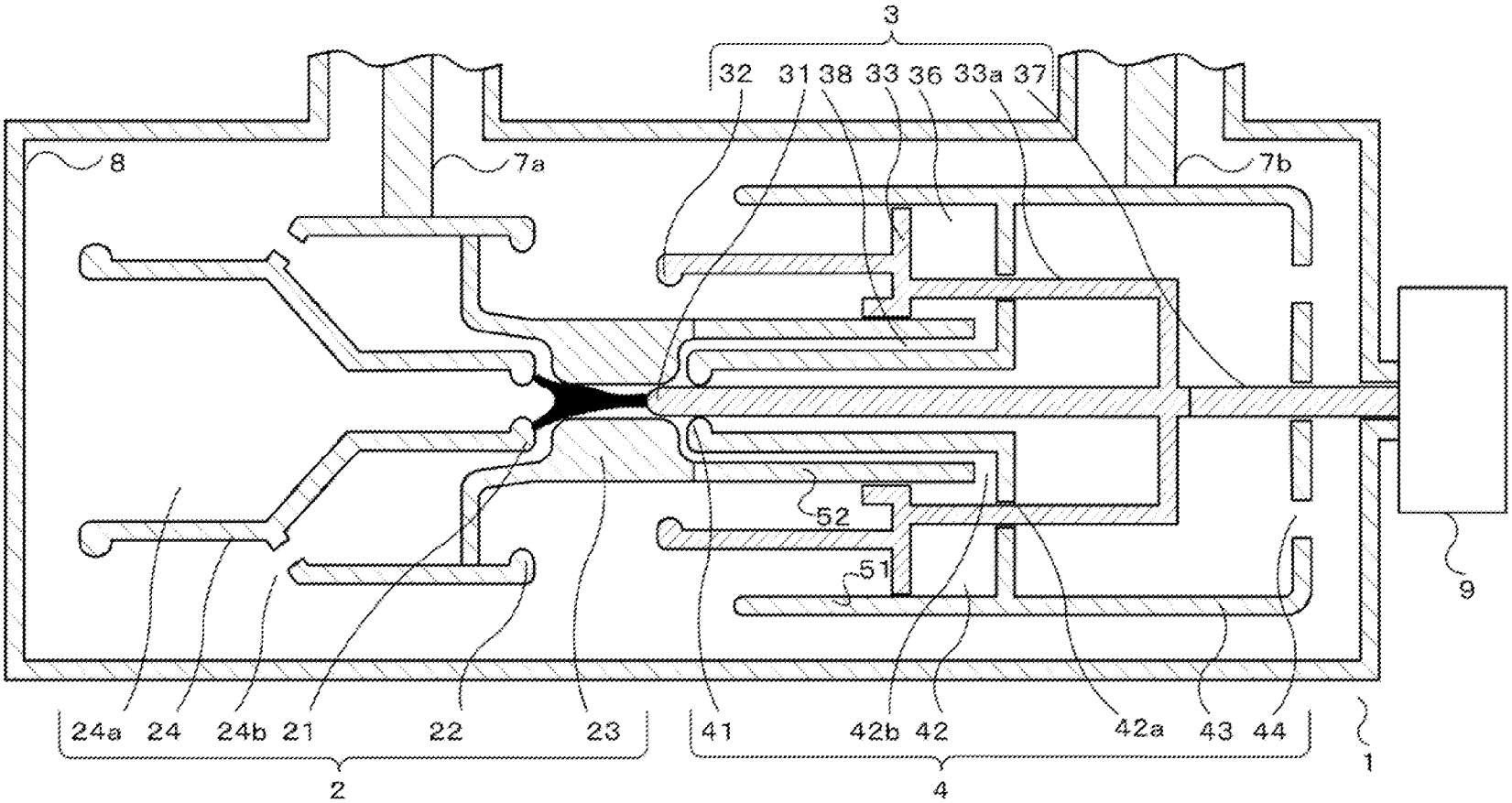
FIG. 2 is a diagram illustrating a first half of a current breaking action of the gas circuit breaker according to the first embodiment.
Figure 3:
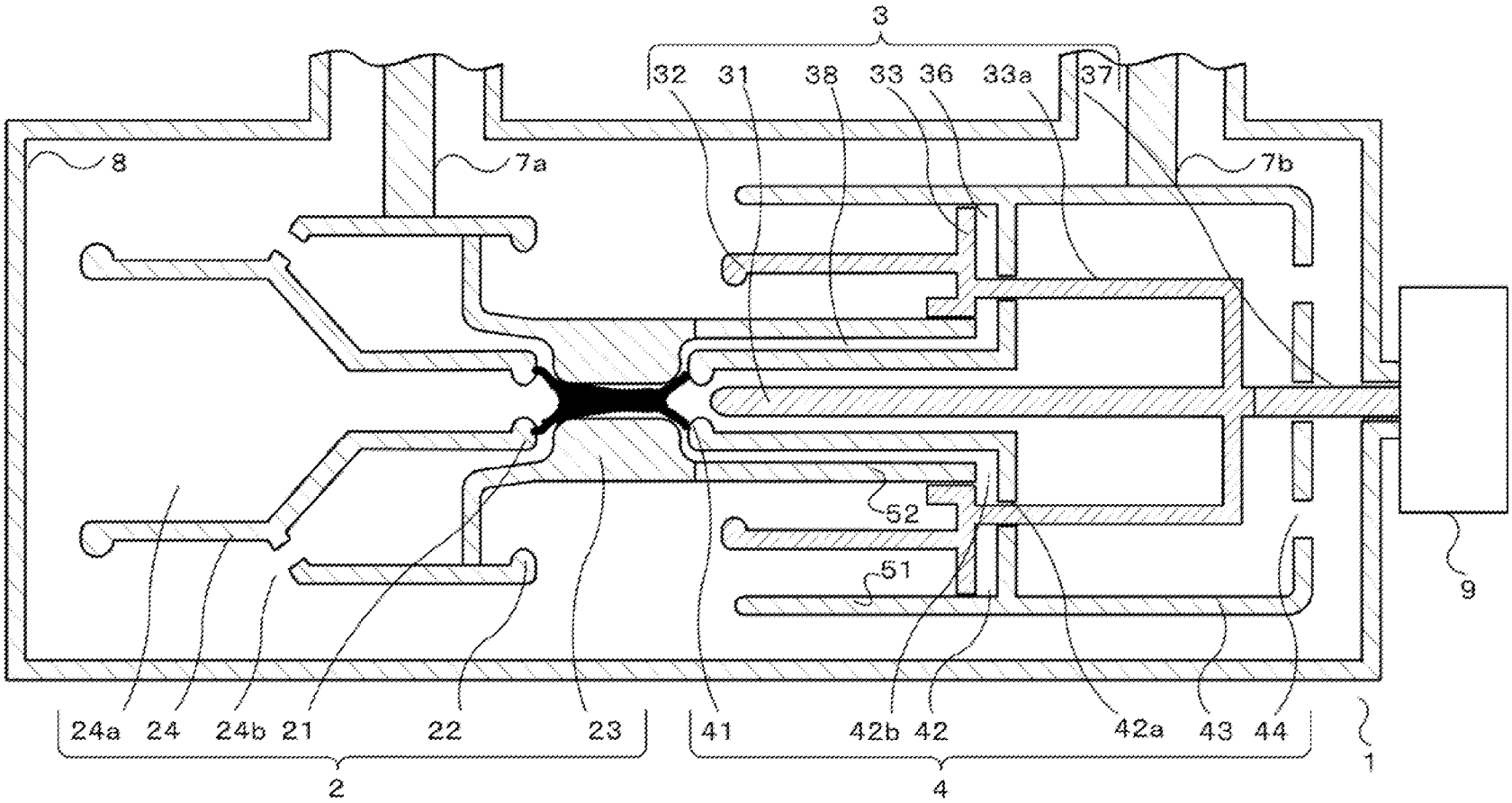
FIG. 3 is a diagram illustrating a latter half of the current breaking action of the gas circuit breaker according to the first embodiment.
Figure 4:
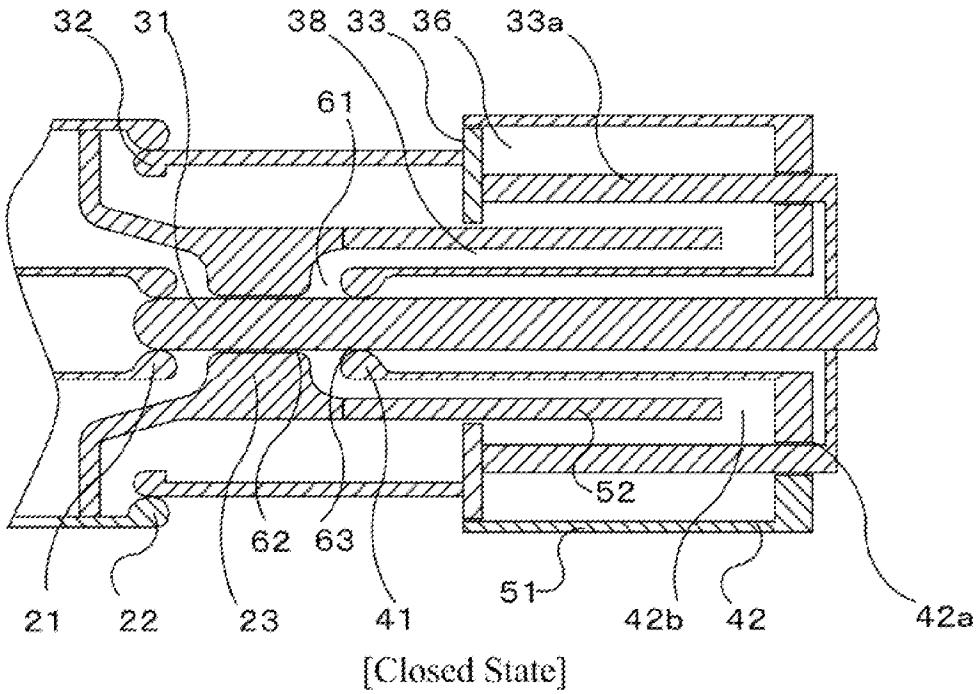
FIG. 4 is an enlarged view illustrating the closed state of the gas circuit breaker according to the first embodiment.
Figure 5:
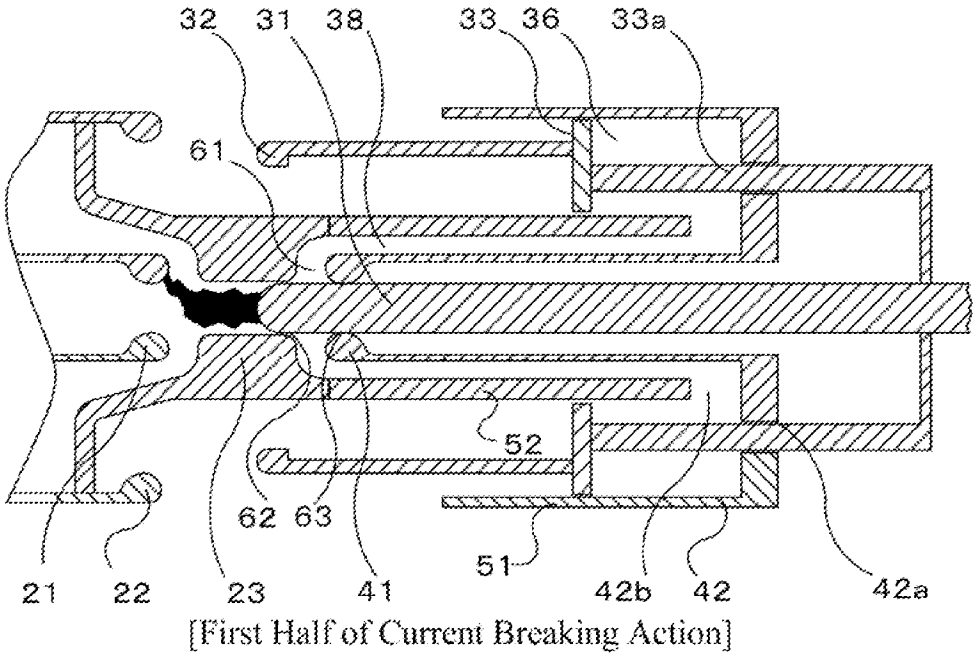
FIG. 5 is an enlarged view illustrating the first half of the current breaking action of the gas circuit breaker according to the first embodiment.
Figure 6:
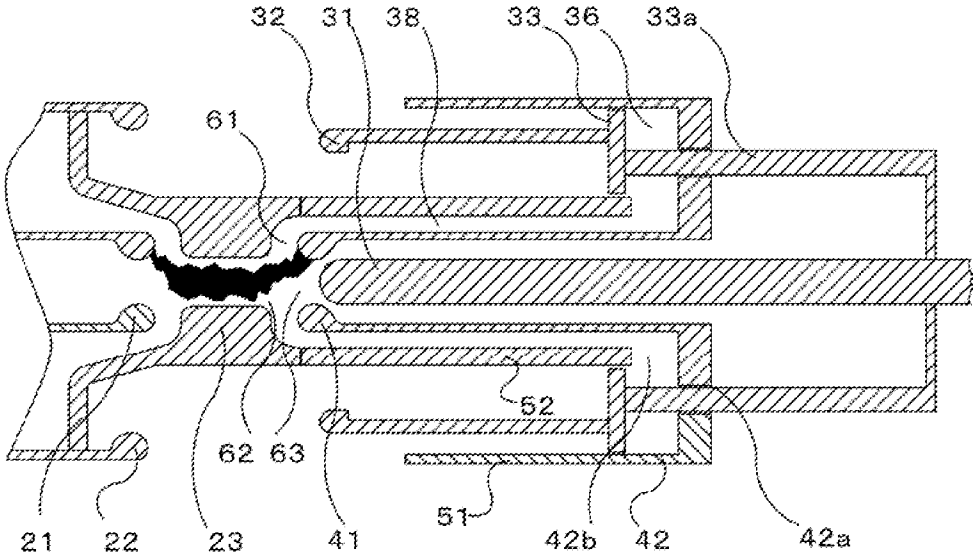
FIG. 6 is an enlarged view illustrating the latter half of the current breaking action of the gas circuit breaker according to the first embodiment.
Figure 7:
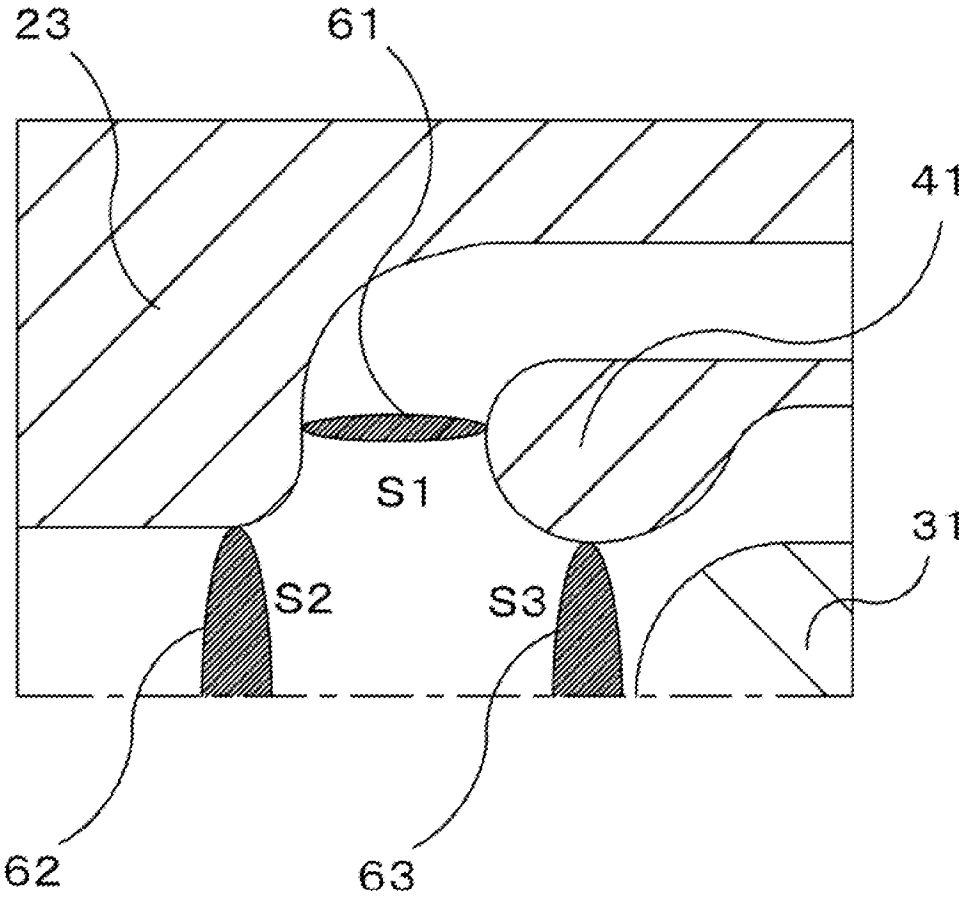
FIG. 7 is an enlarged view illustrating dimensions of a path for the arc-extinguishing gas in the gas circuit breaker according to the first embodiment.
Figure 8:
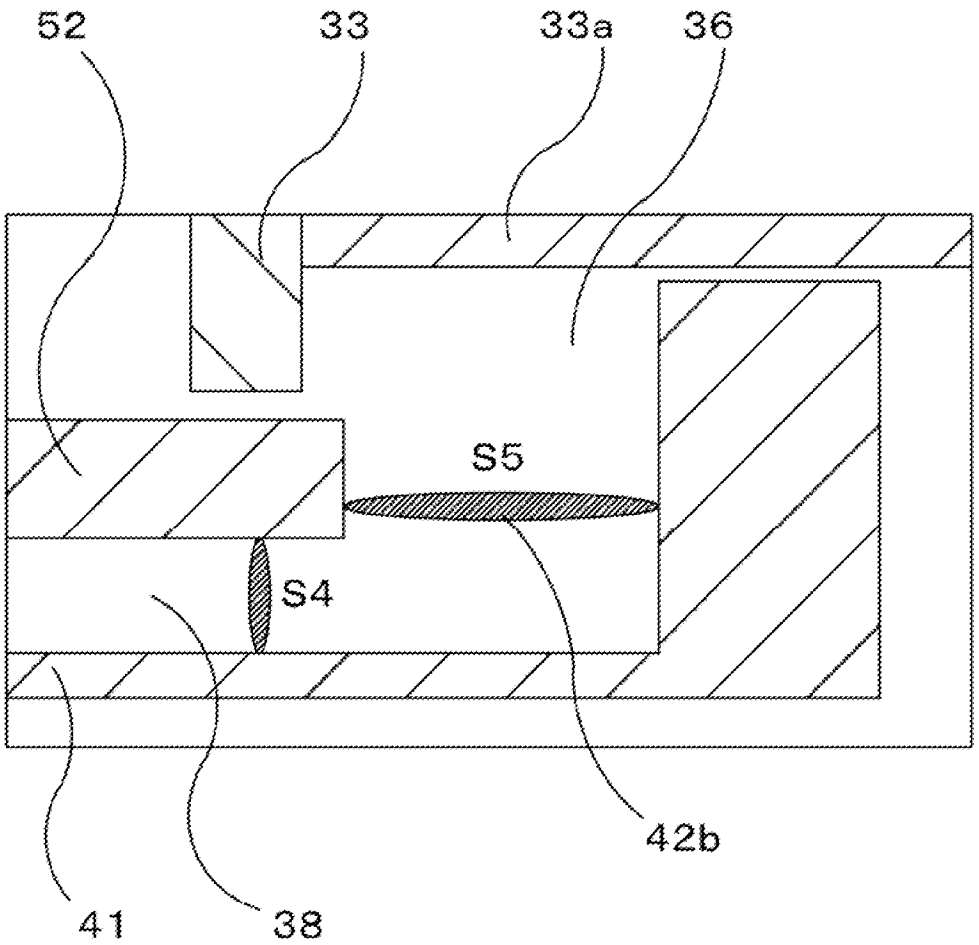
FIG. 8 is an enlarged view illustrating dimensions of a cylinder opening and the path for the arc-extinguishing gas in the gas circuit breaker according to the first embodiment.
Figure 9:
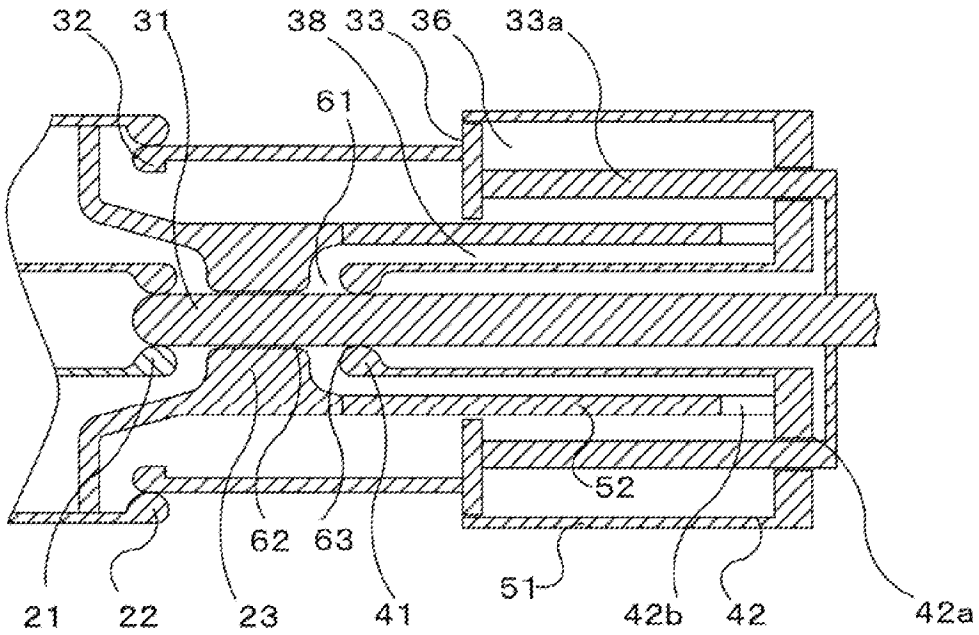
FIG. 9 is an enlarged view of a nozzle portion of the gas circuit breaker according to the first embodiment.

Hereinafter, an entire configuration of a gas circuit breaker 1 of the present embodiment will be described with reference to FIGS. 1 to 9. FIG. 1 illustrates an internal structure of the gas circuit breaker 1 in a closed state.

The gas circuit breaker 1 includes a first fixed contactor portion 2 (hereinafter, referred to as a fixed contactor portion 2), a movable contactor portion 3, a second fixed contactor portion 4 (hereinafter referred to as a fixed contactor portion 4), and a sealed container 8. A lead-out conductor 7*a* is connected to the fixed contactor portion 2 via the sealed container 8, and a lead-out conductor 7*b* is connected to the fixed contactor portion 4 via the sealed container 8. The lead-out conductors 7*a* and 7*b* are connected to a power system. The gas circuit breaker 1 is installed in a power supply facility such as a substation.

The fixed contactor portion 2 and the fixed contactor portion 4 are a cylindrical member made of conductive metal. The movable contactor portion 3 is a cylindrical member made of conductive metal and is arranged to be in close contact with the inner diameter of the fixed contactor portion 2 and the fixed contactor portion 4 and to be slidable. The fixed contactor portion 2 and the fixed contactor portion 4 are separated and fixed by an insulator (not illustrated) in the sealed container 8.

The movable contactor portion 3 is a cylindrical member which is made of conductive metal and which is configured by an insulation rod 37. The movable contactor portion 3 is driven by a driving device 9 arranged outside the gas circuit breaker 1 and moves between the fixed contactor portion 2 and the fixed contactor portion 4 to electrically connect or disconnect the fixed contactor portion 2 and the fixed contactor portion 4. Accordingly, the lead-out conductors 7*a* and 7*b* is electrically connected or disconnected.

Note that, although in the present embodiment, the fixed contactor portion 2 is described as fixed and immovable, the fixed contactor portion 2 may be movable relative to the movable contactor portion 3. This enables to quickly increase an insulation distance between the fixed contactor portion 2 and the movable contactor portion 3 when opening a circuit.

When the gas circuit breaker 1 becomes the opened state, an arc is generated between the fixed contactor portion 2 and the movable contactor portion 3. This arc is extinguished by spraying arc-extinguishing gas filled in the sealed container 8 with a high pressure.

The sealed container 8 is a cylindrical sealed container made of metal, glass, etc., and the arc-extinguishing gas is filled therein. As the arc-extinguishing gas, sulfur hexafluoride gas (SF6 gas) which has excellent arc extinguishing performance and insulation performance is used. When being made of metal, the sealed container 8 is connected to a ground potential. A pressure inside the sealed container 8 in the normal operation is a single pressure, for example, a filling pressure of the arc-extinguishing gas, at any portion of the sealed container 8.

The arc-extinguishing gas is electrical insulation gas for extinguishing the arc. Currently, SF6 gas is used as the arc-extinguishing gas in many cases. However, SF6 gas has high global warming effect. Accordingly, instead of SF6 gas, other gas may be used as the arc-extinguishing gas. It is preferable that arc-extinguishing gas substituting SF6 gas has excellent insulation performance, arc cooling performance (arc extinguishing performance), chemical stability, environmental compatibility, availability, and cost, etc. According to the present embodiment illustrated in FIGS. 1 to 3, since the gas to be sprayed is pressurized by adiabatic compression, it is preferable that the arc-extinguishing gas substituting SF6 gas is gas having a high heat capacity ratio which the pressure of the gas that easily increases at the same cylinder capacity and compression ratio.

The driving device 9 is a device for driving the movable contactor portion 3 at the time opening and closing the gas circuit breaker 1. The driving device 9 has a power source including a spring, a hydraulic pressure, high-pressure gas, and an electric motor, etc. The movable contactor portion 3 is moved between the fixed contactor portion 2 and the fixed contactor portion 4 by the driving device 9, so that the fixed contactor portion 2 and the fixed contactor portion 4 are electrically disconnected from or connected to each other.

The driving device 9 is operated based on a command signal transmitted from the outside at the time of opening and closing the gas circuit breaker 1. The driving device 9 is required to stably store large drive energy, to have extremely quick responsiveness to the command signal, and to operate more reliably. The driving device 9 may not be provided in the arc-extinguishing gas.

In the present embodiment, a guide portion 41 is formed by an arc contactor (at a movable side) 41*a*. When the gas circuit breaker 1 is in the opened state, the arc-extinguishing gas pressurized in a compression chamber to be described later passes through a pressure accumulating path 38 to be described later and is discharged to an arc space between an arc contactor (at a fixed side) 21 and the arc contactor (at the movable side) 41*a*, which is the guide portion 41. It is preferable that a position of a piston 33 of the movable contactor portion 3 is maintained so that the piston 33 does not move reversely until the pressure inside the compression chamber 36 falls sufficiently. When the piston 33 moves reversely, a volume of the compression chamber 36 increases, and the pressures and density of the arc-extinguishing gas in the compression chamber 36 and the pressure accumulating path 38 decrease. This is not preferable because the pressure and density of the arc-extinguishing gas to be sprayed to the arc also decrease.

The fixed contactor portion 2 is a cylindrical member arranged in the sealed container 8. The fixed contactor portion 2 includes the arc contactor (at a fixed side) 21, a fixed conductive contactor 22, an insulation nozzle 23, and an exhaust cylinder 24. The arc contactor (at the fixed side) 21 corresponds to a first arc contactor in the claims. Details of these members will be described later. The lead-out conductor 7*a* is connected to the fixed contactor portion 2 via the sealed container 8. The fixed contactor portion 2 is fixed and arranged to the sealed container 8. When the gas circuit breaker 1 is in the closed state, the fixed contactor portion 2 is electrically connected to the fixed contactor portion 4 via the movable contactor portion 3, and the current flows between the lead-out conductors 7*a* and 7*b*. On the other hand, when the gas circuit breaker 1 is in the opened state, the fixed contactor portion 2 is electrically disconnected from the movable contactor portion 3, and the current between the lead-out conductors 7*a* and 7*b* is broken.

The fixed contactor portion 4 is a cylindrical member arranged in the sealed container 8. The fixed contactor portion 4 includes the arc contactor (at the movable side) 41*a* that is the guide portion 41, a cylinder 42, and a support 43. The arc contactor (at the movable side) 41*a* corresponds to a second arc contactor in the claims. Note that the arc contactor (at the movable side) 41*a* itself is not movable. Details of these members will be described later. The lead-out conductor 7*b* is connected to the fixed contactor portion 4 via the sealed container 8. The fixed contactor portion 4 is fixed and arranged to the sealed container 8.

When the gas circuit breaker 1 is in the closed state, the fixed contactor portion 4 is electrically connected to the fixed contactor portion 2 via the movable contactor portion 3, and the current flows between the lead-out conductors 7*a* and 7*b*. On the other hand, when the gas circuit breaker 1 is in the opened state, the fixed contactor portion 4 is electrically disconnected from the fixed contactor portion 2 and the movable contactor portion 3, and the current between the lead-out conductors 7*a* and 7*b* is broken.

The movable contactor portion 3 is a cylindrical member arranged in the sealed container 8. The movable contactor portion 3 includes a trigger electrode 31, a movable conductive contactor 32, a piston 33, a piston support 33*a*, and an insulation rod 37. Details of these members will be described later. The movable contactor portion 3 is arranged to be reciprocally movable between the fixed contactor portion 2 and the fixed contactor portion 4.

The movable contactor portion 3 is mechanically connected to the driving device 9 arranged outside the gas circuit breaker 1. The movable contactor portion 3 is driven by the driving device 9 to break and conduct the current flowing through the lead-out conductors 7*a* and 7*b* at the time of opening and closing the gas circuit breaker 1. When the gas circuit breaker 1 is in the closed state, the movable contactor portion 3 electrically connects the fixed contactor portion 2 and the fixed contactor portion 4, and the current flows between the lead-out conductors 7*a* and 7*b*. On the other hand, when the gas circuit breaker 1 is in the opened state, the movable contactor portion 3 is electrically disconnected from the fixed contactor portion 2, and the current between the lead-out conductors 7*a* and 7*b* is broken.

In addition, the movable contactor portion 3 compresses the arc-extinguishing gas accumulated in the cylinder 42 by the piston 33, and extinguishes the arc generated between the fixed contactor portion 2 and the movable contactor portion 3 by making the arc-extinguishing gas to blowout from the insulation nozzle 23, to break the arc current.

The fixed contactor portion 2, the movable contactor portion 3, the fixed contactor portion 4, and the sealed container 8 are concentric cylindrical members having a common center axis and are arranged on the same axis. In below, to describe positional relation and direction of each member, a direction toward the fixed contactor portion 2 side is called an open-end direction, and a driving-device direction toward the fixed contactor portion 4 side opposite thereto is called a device-end direction.

[1-2. Detailed Configuration]

(Fixed Contactor Portion 2)

The fixed contactor portion 2 includes the arc contactor (at the fixed side) 21, the fixed conductive contactor 22, the insulation nozzle 23, and the exhaust cylinder 24. The arc contactor (at the fixed side) 21 corresponds to the first arc contactor in the claims. Furthermore, the arc contactor (at the fixed side) 21 may be referred to as the first arc contactor also in the present specification.

(Fixed Conductive Contactor 22)

The fixed conductive contactor 22 is a ring-shape electrode arranged on an end surface of the fixed contactor portion 2 on an outer circumference portion in the device-end direction. The fixed conductive contactor 22 is formed of a metal conductor formed into a ring shape bulging toward the inner diameter side by shaving, etc. The metal forming the fixed conductive contactor 22 is preferably aluminum in view of electric conductivity, lightweight property, strength, and workability, but otherwise, may be, for example, copper.

The fixed conductive contactor 22 has the inner diameter which is slidable and which has a constant clearance, relative to the outer diameter of the movable conductive contactor 32 of the movable contactor portion 3. The fixed conductive contactor 22 is arranged at an end of the exhaust cylinder 24, which is formed of cylindrical conductive metal, in the device-end direction. The exhaust cylinder 24 is connected to the lead-out conductor 7*a* via the sealed container 8. The exhaust cylinder 24 is fixed to the sealed container by an insulation member.

When the gas circuit breaker 1 is in the closed state, the movable conductive contactor 32 of the movable contactor portion 3 is inserted into the fixed conductive contactor 22. Accordingly, the fixed conductive contactor 22 contacts with the movable conductive contactor 32, and the fixed contactor portion 2 and the movable contactor portion 3 are electrically connected to each other. When power is applied, a rated current flows through the fixed conductive contactor 22.

On the other hand, when the circuit breaker 1 is in the opened state, the fixed conductive contactor 22 is physically separated from the movable conductive contactor 32 of the movable contactor portion 3, and the fixed contactor portion 2 and the movable contactor portion 3 are electrically disconnected from each other.

(Arc Contactor (at a Fixed Side) 21)

The arc contactor (at the fixed side) 21 is a cylindrical electrode arranged on an end of the fixed contactor portion 2 on the device-end direction along the center axis of the cylinder of the fixed contactor portion 2. The arc contactor (at the fixed side) 21 is formed of a metal conductor which is formed into a cylindrical shape having a diameter smaller than that of the fixed conductive contactor 22. An end of the arc contactor (at the fixed side) 21 at the open-end direction side is formed into a chamfered curved shape. The arc contactor (at the fixed side) 21 is made of metal containing 10% to 40% of copper and 90% to 60% of tungsten, etc.

When the gas circuit breaker 1 is in the closed state, the arc contactor (at the fixed side) 21 contacts with an outer diameter portion of the trigger electrode 31 of the movable contactor portion 3. The arc contactor (at the fixed side) 21 is integrally fixed to the fixed contactor portion 2 by a support member provided on an inner wall surface of the exhaust cylinder 24 forming an outer circumference of the fixed contactor portion 2. The arc contactor (at the fixed side) 21 is arranged in the arc-extinguishing gas and ignites an arc generated in the arc-extinguishing gas.

The arc contactor (at the fixed side) 21 is fixed and does not contribute to a weight of a movable component which the driving device 9 should drive. Accordingly, a large heat capacity and a large surface area can be achieved, improving the durability of the arc contactor (at the fixed side) 21.

It is preferable that the durability of the arc contactor (at the fixed side) 21, the durability of the arc contactor (at the movable side) 41*a*, and the durability of the trigger electrode 31 have the following relation.

The durability of the arc contactor (at the fixed side) 21≥the durability of the arc contactor (at the movable side) 41*a*> the durability of the trigger electrode 31

This is because the arc contactor (at the fixed side) 21 is more likely to wear compared to the arc contactor (at the movable side) 41*a* for the arc-extinguishing gas flow that has become a high temperature is accelerated and thereafter collides with the arc contactor 21. In addition, this is because a wear level of the trigger electrode 31 is small compared to that on the arc contactor (at the fixed side) 21 and that on the arc contactor (at the movable side) 41*a* for the high-temperature arc is ignited only for a certain period of time until the arc is commutated to the arc contactor (on the movable side) 41*a*, as described below, while it is preferable that the trigger electrode 31 that is a movable component is made more lightweight than the arc contactor (at the fixed side) 21 and the arc contactor (at the movable side) 41*a*, The arc contactor (at the fixed side) 21 is arranged to be separated from the arc contactor (at the movable side) 41*a* at a distance which the insulation can be ensured after the arc is extinguished. Since the arc contactor (at the fixed side) 21 and the arc contactor (at the movable side) 41*a* are fixed and are not movable, the arc contactor (at the fixed side) 21 and the arc contactor (at the movable side) 41*a* can be large in size. Therefore, the electric field in the space between the arc contactor (at the fixed side) 21 and the arc contactor (at the movable side) 41*a* has more uniform distribution (distribution with a lower concentration of the electric field) compared to the conventional technique, and the distance between the arc contactor (at the fixed side) 21 and the arc contactor (at the movable side) 41*a* can be made shorter than the conventional technique.

Furthermore, the flow rate and the flow speed of the arc-extinguishing gas to be sprayed to the arc can be defined based on a flow path cross-sectional area determined by a positional relation between the insulation nozzle 23 and the arc contactor (at the fixed side) 21 and a flow path cross-sectional area determined by a positional relation between the trigger electrode 31 and the arc contactor (at the movable side) 41*a*. It is preferable that the flow path cross-sectional area between the arc contactor (at the fixed side) 21 and the insulation nozzle is larger than the flow path cross-sectional area between the trigger electrode 31 and the arc contactor (at the movable side) 41*a*, because so that the high-temperature gas generated between the arc contactor (at the fixed side) 21 and the arc contactor (at the movable side) 41*a* can be quickly exhausted.

When the gas circuit breaker 1 is in the closed state, the trigger electrode 31 of the movable contactor portion 3 is inserted into the arc contactor (at the fixed side) 21. Accordingly, the arc contactor (at the fixed side) 21 contacts the trigger electrode 31 of the movable contactor portion 3, and the fixed contactor portion 2 and the movable contactor portion 3 are electrically connected to each other. When the gas circuit breaker 1 is in the closed state, the arc contactor (at the fixed side) 21 serves as a conductor which forms a part of a current circuit, so that the lead-out conductors 7*a* and 7*b* are electrically connected to each other.

On the other hand, when the gas circuit breaker 1 is in the opened state, the arc contactor (at the fixed side) 21 is separated from the trigger electrode 31 of the movable contactor portion 3 and ignites an arc generated between the fixed contactor portion 2 and the movable contactor portion 3. The arc contactor (at the fixed side) 21 is an electrode that is arranged to face the trigger electrode 31, and contacts the arc when the gas circuit breaker 1 becomes the opened state.

The trigger electrode 31 is separated from the arc contactor (at the fixed side) 21 after the movable conductive contactor 32 is separated from the fixed conductive contactor 22. Accordingly, the current to be broken is commutated to the trigger electrode 31 and the arc contactor (at the fixed side) 21 side, so that the arc is not generated between the fixed conductive contactor 22 and the movable conductive contactor 32.

Since the arc contactor (at the fixed side) 21 and the trigger electrode 31 are separated from each other after the fixed conductive contactor 22 and the movable conductive contactor 32 are separated from each other, the arc is always ignited between the arc contactor (at the fixed side) 21 and the trigger electrode 31. This reduces the degradation of the fixed conductive contactor 22 and the movable conductive contactor 32 due to the arc.

When the gas circuit breaker 1 becomes the opened state, the movable contactor portion 3 is driven by the driving device 9, and moves between the arc contactor (at the fixed side) 21 and the arc contactor (at the movable side) 41*a* from the open-end direction side to the device-end direction side. Accordingly, the trigger electrode 31 also moves between the arc contactor (at the fixed side) 21 and the arc contactor (at the movable side) 41*a* from the open-end direction side to the device-end direction side. The fixed conductive contactor 22 and the movable conductive contactor 32 are separated from each other before the trigger electrode 31 is separated from the arc contactor (on the fixed side) 21. Accordingly, the arc is not generated between the fixed conductive contactor 22 and the movable conductive contactor 32.

The arc is generated between the trigger electrode 31 and the arc contactor (at the fixed side) 21 from a time point when the trigger electrode 31 starts to separate from the arc contactor (at the fixed side) 21 until when the separation distance between the arc contactor (at the fixed side) 21 and the arc contactor (at the movable side) 41*a* becomes equal to the separation distance between the arc contactor (at the fixed side) 21 and the trigger electrode 31.

When the separation distance between the arc contactor (at the fixed side) 21 and the arc contactor (at the movable side) 41*a* becomes approximately equal to the separation distance between the arc contactor (at the fixed side) 21 and the trigger electrode 31, the arc is transferred from the trigger electrode 31 to the arc contactor (at the movable side) 41*a*. The arc is generated between the arc contactor (at the movable side) 41*a* and the arc contactor (at the fixed side) 21 from a time point when the separation distance between the arc contactor (at the fixed side) 21 and the arc contactor (at the movable side) 41*a* becomes approximately equal to the separation distance between the arc contactor (at the fixed side) 21 and the trigger electrode 31 until when the arc is extinguished. At this time, the arc contactor (at the movable side) 41*a* and the arc contactor (at the fixed side) 21 form a pair of electrodes that are arranged to face each other, and ignite the arc.

The period of time from a time point when the trigger electrode 31 starts to separate from the arc contactor (at the fixed side) 21 until when the separation distance between the arc contactor (at the fixed side) 21 and the arc contactor (at the movable side) 41*a* becomes equal to the separation distance between the arc contactor (at the fixed side) 21 and the trigger electrode 31 may be referred to as a "first half of a current breaking action."

The period of time from a time point when the separation distance between the arc contactor (at the fixed side) 21 and the arc contactor (at the movable side) 41*a* becomes equal to the separation distance between the arc contactor (on the fixed side) 21 and the trigger electrode 31 until when the arc is extinguished may be referred to as a "latter half of the current breaking action."

The trigger electrode 31 further moves in the device-end direction, that is, in a direction in which the separation distance between the arc contactor (at the fixed side) 21 and the trigger electrode 31 becomes larger than the separation distance between the arc contactor (at the fixed side) 21 and the arc contactor (at the movable side) 41*a*. This causes the trigger electrode 31 to be separated from the arc generated between the arc contactor (at the movable side) 41*a* and the arc contactor (at the fixed side) 21, reducing the degradation of the trigger electrode 31.

The trigger electrode 31 further moves in the device-end direction. At this time, the arc-extinguishing gas pressurized in the compression chamber 36 that is formed by the piston 33 and the cylinder 42 is sprayed via the pressure accumulating path 38 and the insulation nozzle 23, and the arc between the arc contactor (at the fixed side) 21 and the arc contactor (at the movable side) 41*a* is extinguished.

(Insulation Nozzle 23)

The insulation nozzle 23 is a cylindrical rectifying member having a throat portion that defines a flow speed balance of the arc-extinguishing gas pressurized in the compression chamber 36. The insulation nozzle 23 is made of an insulating material such as acrylic, polycarbonate, polystyrene, polyethylene, polypropylene, polyolefin, PTFE (polytetrafluoroethylene) resin, or a combination thereof. The above-described resin material may be filled with at least one of BN, $Al_2O_3$, ZnO, $TiO_2$, CaF, and $CeO_2$ A ceramic material of at least one of $BaTiO_3$, $PbO_3$, $ZrO_3$, $TiO_2$, $ZrO_2$, $SiO_2$, MgO, AlN, $Si_3N_4$, SiC, and $Al_2O_3$ may be coated on a surface of the insulation nozzle 23 that guides the arc-extinguishing gas to the arc discharge.

Alternatively, the insulation nozzle 23 may be made of a ceramic material of at least one of $BaTiO_3$, $PbO_3$, $ZrO_3$, $TiO_2$, $ZrO_2$, $SiO_2$, MgO, AlN, $Si_3N_4$, SiC, and $Al_2O_3$ instead of acrylic, polycarbonate, polystyrene, polyethylene, polypropylene, polyolefin, or PTFE.

The insulation nozzle 23 is integrally fixed to the fixed contactor portion 2 and is arranged so that an axis of the cylinder of the insulation nozzle 23 is located on the cylindrical axis of the arc contactor (at the fixed side) 21. An end of the insulation nozzle 23 at the device-end direction side is joined to an inner wall 52 of the cylinder 42 to be described later. In this way, the insulation nozzle 23 is supported by the inner wall 52 of the cylinder 42.

In a position where the distance between the arc contactor (at the fixed side) 21 and the arc contactor (at the movable side) 41*a* is substantially equal to the distance between the arc contactor (at the fixed side) 21 and a joining portion between the insulation nozzle 23 and the inner wall 52, the insulation nozzle 23 is joined to the inner wall 52 of the cylinder 42. The inner wall 52 is made of a conductive material and has the same potential as the movable conductive contactor 32, thereby preventing the steepening of a potential gradient between the fixed conductive contactor 22 and the movable conductive contactor 32.

The insulation nozzle 23 is arranged to surround the trigger electrode 31 when the gas circuit breaker 1 is in the closed state. An opening 62 having an opening area S2 is formed inside the insulation nozzle 23. The opening area S2 of the opening 62 that is the inner diameter allows the trigger electrode 31 to be slidable therein, and is an area that ensures the air tightness of the arc-extinguishing gas when the trigger electrode 31 is inserted into the opening 62. The opening 62 corresponds to a second opening in the claims, and the opening area S2 corresponds to a second opening area in the claims.

When the gas circuit breaker 1 is in the closed state and in the first half of the current breaking action, the trigger electrode 31 is inserted to the opening 62 of the insulation nozzle 23 to close the opening 62 of the insulation nozzle 23, so that the air tightness of the arc-extinguishing gas is ensured. In the latter half of the current breaking action, the trigger electrode 31 is separated from the opening 62 of the insulation nozzle 23 to open the opening 62. When the gas circuit breaker 1 is in the closed state and in the first half of the current breaking action, it is preferable that the insulation nozzle 23 and the trigger electrode 31 are in close contact with each other to an level that the air tightness of the arc-extinguishing gas is ensured. However, the trigger electrode 31 slides in the insulation nozzle 23. In addition, when the trigger electrode 31 and the insulation nozzle 23 are too close to each other, the possibility that a so-called triple junction is created increases. Therefore, a gap may be formed between the insulation nozzle 23 and the trigger electrode 31 to an level that a predetermined air tightness of the arc-extinguishing gas is ensured.

The arc-extinguishing gas pressurized in the compression chamber 36 is guided to the arc space by the insulation nozzle 23. In addition, by the insulation nozzle 23, the arc-extinguishing gas is concentrated in the arc space, and the flow speed of the arc-extinguishing gas is increased. The insulation nozzle 23 may be configured to form a conical space in which the inner diameter decreases from the open-end direction side toward the device-end direction side.

When the gas circuit breaker 1 becomes the opened state, the arc-extinguishing gas in the compression chamber 36 formed by the piston 33 of the movable contactor portion 3 and the cylinder 42 of the fixed contactor portion 4 is pressurized. The outer circumference of the arc contactor (at the movable side) 41*a* and the inner circumference of the inner wall 52 of the cylinder 42 form the pressure accumulating path 38 which is a path for the pressurized arc-extinguishing gas.

In the latter half of the current breaking action, the arc-extinguishing gas in the compression chamber 36 which is pressurized by the piston 33 and the cylinder 42 is sprayed to the arc space between the arc contactor (at the fixed side) 21 and the arc contactor (at the movable side) 41*a* via the pressure accumulating path 38.

At this time, the pressurized arc-extinguishing gas is concentrated in the arc space by the insulation nozzle 23. Accordingly, the arc between the arc contactor (at the movable side) 41*a* and the arc contactor (at the fixed side) 21 is efficiently extinguished, and the arc contactor (at the movable side) 41*a* and the arc contactor (at the fixed side) 21 are electrically disconnected from each other.

Thermal energy generated by the arc discharge is removed by the arc-extinguishing gas. The arc-extinguishing gas gains the thermal energy generated by the arc discharge and becomes high temperature and high pressure. The arc-extinguishing gas that has become a high temperature and a high pressure is discharged from exhaust ports 24*a* and 24*b* of the exhaust cylinder 24, so that the thermal energy is eliminated from electrode regions.

The arc-extinguishing gas that has been sprayed to the arc space between the arc contactor (at the fixed side) 21 and the arc contactor (at the movable side) 41*a* and become a high temperature is cooled by passing through the exhaust cylinder 24 of the fixed contactor portion 2, recovers the insulation performance, and is exhausted into the sealed container 8.

The insulation nozzle 23 concentratedly guides the pressurized arc-extinguishing gas to the arc space. The insulation nozzle 23 accelerates the arc-extinguishing gas and improves the discharging performance of the thermal energy. The insulation nozzle 23 appropriately controls the flow rate and the flow speed of the arc-extinguishing gas. The insulation nozzle 23 defines the exhaust path of the arc-extinguishing gas heated to a high temperature by the arc, and suppresses dielectric breakdown between the fixed conductive contactor 22 and the movable conductive contactor 32. Furthermore, the insulation nozzle 23 suppresses expansion of the arc and defines the maximum diameter of the arc.

Therefore, the arc-extinguishing gas is efficiently sprayed to the arc generated between the arc contactor (at the movable side) 41*a* and the arc contactor (at the fixed side) 21, the thermal energy is efficiently removed, and the arc is extinguished. As a result, the arc contactor (at the movable side) 41*a* and the arc contactor (at the fixed side) 21 are electrically disconnected from each other.

In the conventional technique, there are many cases where the insulation nozzle 23 is provided in the movable contactor portion 3, together with the movable conductive contactor 32. However, it is preferable to reduce the weight of the movable contactor portion 3 for the movable contactor portion 3 to move. Accordingly, it is preferable that the insulation nozzle 23 is provided in the fixed contactor portion 2 that is not movable. Note that the insulation nozzle 23 may be provided in the movable contactor portion 3.

The insulation nozzle 23 may be provided in either the fixed contactor portion 2 or the movable contactor portion 3, but the movable contactor portion 3 vibrates because it is movable. Accordingly, electrical performance deterioration due to the vibration can be more suppressed in the case where the insulation nozzle 23 is provided in the fixed contactor portion 2 compared with the case where the insulation nozzle 23 is provided in the movable contactor portion 3.

In addition, since the insulation nozzle 23 can suppress the flowing in of the arc-extinguishing gas with low insulation performance and a high temperature into the fixed conductive contactor 22, it is preferable that the insulation nozzle 23 is provided in the fixed contactor portion 2.

The inner wall 52 of the cylinder 42 supports the insulation nozzle 23. Since the insulation nozzle 23 is supported by the inner wall 52 of the cylinder 42, the separation distance between the insulation nozzle 23 and the trigger electrode 31 is maintained over time.

The insulation nozzle 23 not only creates the arc-extinguishing gas flow parallel to the axis from the device-end direction side to the open-end direction side, but also creates the arc-extinguishing gas flow in a direction crossing the arc. The arc is efficiently cooled by this flow. Since the arc-extinguishing gas which has been sprayed to the arc and become a high temperature has low insulation performance, it is preferable that the arc-extinguishing gas is exhausted without contacting the fixed conductive contactor 22 and the movable conductive contactor 32.

(Exhaust Cylinder 24)

The exhaust cylinder 24 is a cylindrical member made of conductive metal formed by shaving. The arc contactor (at the fixed side) 21 and the fixed conductive contactor 22 are arranged at the end of the exhaust cylinder 24 on the device-end direction side, so that the axes thereof are aligned with the axis of the exhaust cylinder 24. The exhaust cylinder 24 has the exhaust ports 24*a* and 24*b* for exhausting the arc-extinguishing gas that has become a high temperature. The exhaust cylinder 24 may be formed integrally with the arc contactor (at the fixed side) 21 and the fixed conductive contactor 22.

The lead-out conductor 7*a* is connected to the exhaust cylinder 24 via the sealed container 8. The exhaust cylinder 24 is an arc-extinguishing gas flow path, and guides the arc-extinguishing gas which has been sprayed to the arc and has become a high temperature from the arc space between the arc contactor (at the fixed side) 21 and the trigger electrode 31 to the sealed container 8.

When the gas circuit breaker 1 becomes the opened state, the arc-extinguishing gas in the compression chamber 36 formed by the piston 33 of the movable contactor portion 3 and the cylinder 42 of the fixed contactor portion 4 is pressurized, and is sprayed to the arc space between the arc contactor (at the fixed side) 21 and the arc contactor (at the movable side) 41*a*. The arc-extinguishing gas that has been sprayed to the arc and become a high temperature passes through the arc space, and is exhausted into the sealed container 8 through the exhaust ports 24*a* and 24*b* of the exhaust cylinder 24.

(Fixed Contactor Portion 4)

The fixed contactor portion 4 includes the arc contactor (at the movable side) 41*a*, the cylinder 42, and the support 43. In the present embodiment, the guide portion 41 is formed by the arc contactor (at the movable side) 41*a*. The arc contactor (at the movable side) 41*a* corresponds to the second arc contactor and the guide portion in the claims. Furthermore, the arc contactor (at the movable side) 41*a* may be referred to as the second arc contactor or the guide portion also in the present specification.

(Arc Contactor (at a Movable Side) 41*a*)

The arc contactor (on the movable side) 41*a* as the guide portion 41 is a cylindrical electrode that is arranged on an end of the fixed contactor portion 4 at the open-end direction side along the center axis of the cylinder of the fixed contactor portion 4. The arc contactor (at the movable side) 41*a* is formed of a metal conductor which is formed into a cylindrical shape having a diameter substantially equal to that of the arc contactor (at the fixed side) 21. An end of the arc contactor (at the movable side) 41*a* at the open-end direction side is formed into a chamfered curved shape. The arc contactor (at the movable side) 41*a* is made of metal containing 10% to 40% of copper and 90% to 60% of tungsten, etc.

The outer circumference of the arc contactor (at the movable side) 41*a* and the inner circumference of the inner wall 52 of the cylinder 42 form the pressure accumulating path 38 which is a path for the pressurized arc-extinguishing gas. In the latter half of the current breaking action, the arc-extinguishing gas in the compression chamber 36 which is pressurized by the piston 33 and the cylinder 42 is sprayed to the arc space between the arc contactor (at the fixed side) 21 and the arc contactor (at the movable side) 41*a* via the pressure accumulating path 38.

The arc contactor (at the movable side) 41*a* is arranged to surround the trigger electrode 31. An opening 63 having an opening area S3 is formed inside the arc contactor (at the movable side) 41*a*. The opening area S3 of the opening 63 that is the inner diameter allows the trigger electrode 31 to be slidable therein, and is an area that ensures the air tightness of the arc-extinguishing gas when the trigger electrode 31 is inserted into the opening 63. The opening 63 corresponds to a third opening in the claims, and the opening area S3 corresponds to a third opening area in the claims.

When the gas circuit breaker 1 is in the closed state and in the first half of the current breaking action, the trigger electrode 31 is inserted to the opening 63 of the arc contactor (at the movable side) 41*a* to close the opening 63 of the arc contactor (at the movable side) 41*a*, so that the air tightness of the arc-extinguishing gas is ensured. In the latter half of the current breaking action, the trigger electrode 31 is separated from the opening 63 of the arc contactor (at the movable side) 41*a*, to open the opening 63.

When the opening 63 is opened, the arc-extinguishing gas guided to the arc space passes through the interior of the arc contactor (at the movable side) 41*a* and is exhausted in the device-end direction. The arc contactor (at the movable side) 41*a* guides the arc-extinguishing gas in the device-end direction. The arc contactor (at the movable side) 41*a* corresponds to the second arc contactor and the guide portion in the claims.

The arc contactor (at the movable side) 41*a* is fixed by an insulation support member via the support 43 forming an outer circumference of the fixed contactor portion 4. The arc contactor (at the movable side) 41*a* is fixed by the support 43 and does not move. Therefore, the arc contactor (at the movable side) 41*a* is not included in a weight of a movable component driven by the driving device 9. Accordingly, the heat capacity and the surface area can be increased without increasing a driving force of the driving device 9, and can improve the durability of the arc contactor (at the movable side) 41*a*.

The arc contactor (at the movable side) 41*a* is arranged to be separated from the arc contactor (at the fixed side) 21 at a distance which the insulation performance can be ensured after the arc is extinguished. Since the arc contactor (at the movable side) 41*a* and the arc contactor (at the fixed side) 21 are fixed and do not move, the surface area of the arc contactor (at the movable side) 41*a* can be increased without increasing a driving force of the driving device 9. Accordingly, the electric field distribution between the arc contactor (at the movable side) 41*a* and the arc contactor (at the fixed side) 21 can be more approximated to uniform electric field, and the distance between the arc contactor (at the movable side) 41*a* and the arc contactor (at the fixed side) 21 can be made shorter than the conventional technique.

Furthermore, the flow rate and the flow speed of the arc-extinguishing gas to be sprayed to the arc can be defined based on a flow path cross-sectional area determined by a positional relation between the insulation nozzle 23 and the arc contactor (at the fixed side) 21 and a flow path cross-sectional area determined by a positional relation between the trigger electrode 31 and the arc contactor (at the movable side) 41*a*. It is preferable that the flow path cross-sectional area between the arc contactor (at the fixed side) 21 and the insulation nozzle 23 is larger than the flow path cross-sectional area between the trigger electrode 31 and the arc contactor (at the movable side) 41*a*, because so that the high-temperature gas generated between the arc contactor (at the fixed side) 21 and the arc contactor (at the movable side) 41*a* can be quickly exhausted.

An opening 61 having an opening area S1 is formed between the outside of the guide portion 41 and the insulation nozzle 23. The opening 61 corresponds to a first opening in the claims, and the opening area S1 corresponds to a first opening area in the claims. In the latter half of the current breaking action, the arc-extinguishing gas is sprayed from the opening 61 to the arc space between the arc contactor (at the fixed side) 21 and the arc contactor (at the movable side) 41*a*.

The sum of the opening area S2 of the opening 62 and the opening area S3 of the opening 63 is less than the opening area S1 of the opening 61.

$$S1 > S2 + S3 \quad \text{(Formula 1)}$$

When the opening area S1 of the opening 61 which is at an upstream side of the arc-extinguishing gas flow is larger than the sum of the opening area S2 of the opening 62 and the opening area S3 of the opening 63 which are at a downstream side of the arc-extinguishing gas flow, the arc-extinguishing gas is guided to the arc space between the arc contactor (at the fixed side) 21 and the arc contactor (at the movable side) 41*a* fluently. This can reduce the pressure loss of the arc-extinguishing gas and increase the gas density of the arc-extinguishing gas. Since the opening 62 and the opening 63 approach the arc, the opening 62 and the opening 63 become a high temperature, which may cause deformation due to melting, ablation, and sublimation, etc. such that the opening area S2 and the opening area S3 may increase. Even when the opening 62 and the opening 63 become a high temperature and are deformed, it is preferable that the opening area S1 of the opening 61, the opening area S2 of the opening 62, and the opening area S3 of the opening 63 are selected to satisfy the (Formula 1) described above.

The arc-extinguishing gas passes through the opening 62 formed inside the insulation nozzle 23 and the opening 63 formed inside the arc contactor (at the movable side) 41*a*, and is discharged to a large space filled with the arc-extinguishing gas with low pressure. Accordingly, the arc-extinguishing gas flows faster.

The fixed contactor portion 4 and the movable contactor portion 3 are configured to always have the same potential and to always be brought into a conductive state, via a sliding contact, etc. Since the trigger electrode 31 of the movable contactor portion 3 is inserted into the arc contactor (at the fixed side) 21 when the gas circuit breaker 1 is in the closed state, the fixed contactor portion 2 and the fixed contactor portion 4 are electrically connected via the movable contactor portion 3. When the gas circuit breaker 1 is in the closed state, the arc contactor (at the movable side) 41*a* serves as a conductor which forms a part of an electrical circuit so that the lead-out conductors 7*a* and 7*b* are electrically connected.

On the other hand, since the trigger electrode 31 of the movable contactor portion 3 is separated from the arc contactor (at the fixed side) 21 of the fixed contactor portion 2 when the gas circuit breaker 1 is in the opened state, the arc contactor (at the movable side) 41*a* is electrically disconnected from the arc contactor (at the fixed side) 21.

However, when the gas circuit breaker 1 becomes the opened state, the trigger electrode 31 of the movable contactor portion 3 and the arc contactor (at the fixed side) 21 of the fixed contactor portion 2 are mechanically separated from each other, but are in an electrically conductive state by the generated arc. Accordingly, in a state in which the arc is present, the arc contactor (at the movable side) 41*a* and the arc contactor (at the fixed side) 21 are in an electrically conductive state.

When the gas circuit breaker 1 becomes the opened state, the movable contactor portion 3 is driven by the driving device 9 to move between the arc contactor (at the fixed side) 21 and the arc contactor (at the movable side) 41*a* from the open-end direction side to the device-end direction side. Accordingly, the trigger electrode 31 also moves between the arc contactor (at the fixed side) 21 and the arc contactor (at the movable side) 41*a* from the open-end direction side to the device-end direction side.

The fixed conductive contactor 22 and the movable conductive contactor 32 are separated from each other before the trigger electrode 31 is separated from the arc contactor (on the fixed side) 21. This produces the arc at between the trigger electrode 31 and the arc contactor (at the fixed side) 21, not at between the fixed conductive contactor 22 and the movable conductive contactor 32.

The arc is generated between the trigger electrode 31 and the arc contactor (at the fixed side) 21 from a time point when the trigger electrode 31 starts to separate from the arc contactor (at the fixed side) 21 until when a separation distance between the arc contactor (at the fixed side) 21 and the arc contactor (on the movable side) 41*a* becomes equal to the separation distance between the arc contactor (at the fixed side) 21 and the trigger electrode 31.

When the separation distance between the arc contactor (at the fixed side) 21 and the arc contactor (on the movable side) 41*a* becomes equal to the separation distance between the arc contactor (at the fixed side) 21 and the trigger electrode 31, the arc is transferred from the trigger electrode 31 to the arc contactor (at the movable side) 41*a*.

The arc is generated between the arc contactor (at the movable side) 41*a* and the arc contactor (at the fixed side) 21 from a time point when the separation distance between the arc contactor (at the fixed side) 21 and the arc contactor (at the movable side) 41*a* becomes equal to the separation distance between the arc contactor (at the fixed side) 21 and the trigger electrode 31 until the arc is extinguished. At this time, the arc contactor (at the movable side) 41*a* and the arc contactor (at the fixed side) 21 form a pair of electrodes arranged to face each other, and bear the arc.

The trigger electrode 31 further moves in the device-end direction, that is, in a direction in which the separation distance between the arc contactor (at the fixed side) 21 and the trigger electrode 31 becomes larger than the separation distance between the arc contactor (at the fixed side) 21 and the arc contactor (at the movable side) 41*a*. This causes the trigger electrode 31 to be separated from the arc generated between the arc contactor (at the movable side) 41*a* and the arc contactor (at the fixed side) 21, reducing the degradation of the trigger electrode 31.

The trigger electrode 31 further moves in the device-end direction. At this time, the arc-extinguishing gas pressurized in the compression chamber 36 is sprayed via the pressure accumulating path 38 and the insulation nozzle 23, and the arc between the arc contactor (at the fixed side) 21 and the arc contactor (at the movable side) 41*a* is extinguished.

When the trigger electrode 31 is moved by the driving device 9 in the device-end direction, the arc is transferred from the trigger electrode 31 to the arc contactor (at the movable side) 41*a*. The arc contactor (at the movable side) 41*a* and the arc contactor (at the fixed side) 21 are electrically connected to each other by the arc, but become the opened state when the arc is extinguished by the arc-extinguishing gas.

In addition, when the gas circuit breaker 1 becomes the opened state, it is preferable to reduce the degradation of the fixed conductive contactor 22 and the movable conductive contactor 32 due to the arc. Although the fixed conductive contactor 22 and the movable conductive contactor 32 are separated from each other, the arc contactor (at the fixed side) 21, the trigger electrode 31, and arc contactor (at the movable side) 41*a* bear the arc to prevent the arc from being generated between the fixed conductive contactor 22 and the movable conductive contactor 32. Therefore, the trigger electrode 31 and the arc contactor (at the fixed side) 21 contact each other while maintaining a sufficiently high electrical conductivity until the fixed conductive contactor 22 and the movable conductive contactor 32 are separated from each other to maintain a good conductive state.

When the gas circuit breaker 1 becomes the opened state, the arc-extinguishing gas in the compression chamber 36 formed by the piston 33 of the movable contactor portion 3 and the cylinder 42 of the fixed contactor portion 4 is pressurized.

After the pressurization of the arc-extinguishing gas in the compression chamber 36 has completed or has advanced for a predetermined level, the arc contactor (at the movable side) 41*a* and the trigger electrode 31 are separated from each other, and the arc-extinguishing gas in the compression chamber 36 which is pressurized by the piston 33 and the cylinder 42 is sprayed to the arc space between the arc contactor (at the fixed side) 21 and the arc contactor (at the movable side) 41*a* via the pressure accumulating path 38.

Accordingly, the arc between the arc contactor (at the movable side) 41*a* and the arc contactor (at the fixed side) 21 is extinguished, and the arc contactor (at the movable side) 41*a* and the arc contactor (at the fixed side) 21 are electrically disconnected.

(Cylinder 42)

The cylinder 42 is a cylindrical member which is formed of a metal conductor and which has a bottom at one end and an opening at the other end. The cylinder 42 has a cylindrical inner wall 52 therein and forms a torus-shaped space. The cylinder 42 has the outer wall 51 forming an outer circumference portion. The inner wall 52 and the outer wall 51 are configured to form a concentric circle with the arc contactor (at the movable side) 41*a*. The cylinder 42 forms a torus-shaped space partitioned by the outer wall 51 and the inner wall 52.

The outer wall 51 of the cylinder 42 has an inner diameter that is slidable with an outer diameter of the piston 33 of the movable contactor portion 3. Furthermore, the inner wall 52 of the cylinder 42 has the outer diameter that is slidable with a hole diameter of the torus-shaped of the piston 33.

An end of the inner wall 52 of the cylinder 42 at the open-end direction side is joined to the end of the insulation nozzle 23 at the device-end direction side.

The inner wall 52 of the cylinder 42 supports the insulation nozzle 23. The air tightness in the joining portion between the inner wall 52 of the cylinder 42 and the insulation nozzle 23 is ensured.

It is preferable that a joining portion between the insulation nozzle 23 and the inner wall 52, and the inner wall 52 of the cylinder 42 are formed thin to reduce the pressure decrease of the arc-extinguishing gas compressed to be sprayed to the arc. It is preferable that the joining portion between the insulation nozzle 23 and the inner wall 52, and the inner wall 52 of the cylinder 42 are formed to have a thickness of about 15 mm or less.

If the joining portion between the insulation nozzle 23 and the inner wall 52, and the inner wall 52 of the cylinder 42 are formed thick, the deformation of the insulation nozzle 23 due to the high-pressure arc-extinguishing gas that has become a high temperature is reduced. However, the pressure of the arc-extinguishing gas pressurized in the compression chamber 36 decreases when the arc-extinguishing gas flows into the pressure accumulating passage 38. Accordingly, it is preferable that the joining portion between the insulation nozzle 23 and the inner wall 52, and the inner wall 52 of the cylinder 42 are formed thin.

In the position where the distance between the arc contactor (at the fixed side) 21 and the arc contactor (at the movable side) 41*a* is substantially equal to the distance between the arc contactor (at the fixed side) 21 and the joining portion between the insulation nozzle 23 and the inner wall 52, the insulation nozzle 23 is joined to the inner wall 52 of the cylinder 42. The inner wall has the same potential as the movable conductive contactor 32, thereby preventing steepening of a potential gradient between the fixed conductive contactor 22 and the movable conductive contactor 32.

The cylinder 42 is arranged in the fixed contactor portion 4 so that the bottom is placed at the device-end direction side and the opening is placed at the open-end direction side. The cylinder 42 is arranged in the arc-extinguishing gas. The bottom of the cylinder 42 has an insertion hole 42*a* into which the piston support 33*a* for supporting the piston 33 of the movable contactor portion 3 is inserted.

The piston 33 is inserted into the cylinder 42, and the compression chamber 36 is formed for pressurizing the arc-extinguishing gas. When the gas circuit breaker 1 becomes the opened state, the cylinder 42 and the piston 33 compress the arc-extinguishing gas in the compression chamber 36. The cylinder 42 and the piston 33 ensure air tightness of the compression chamber 36. In this way, the arc-extinguishing gas in the compression chamber 36 is pressurized.

A through hole 42*b* is provided in the inner wall 52 of the cylinder 42. The through hole 42*b* connects the compression chamber 36 and the pressure accumulating path 38. The through hole 42*b* has an opening area S5. The pressure accumulating path 38 has the narrowest passage diameter that is an opening area S4. The opening area S4 corresponds to a fourth opening area in the claims, and the opening area S5 corresponds to a fifth opening area in the claims. The pressure accumulating path 38 may be formed so that the opening area decreases from the device-end direction side toward the open-end direction side.

In the latter half of the current breaking action, the sealing of the insulation nozzle 23 by the trigger electrode 31 is opened, and the arc-extinguishing gas pressurized in the compression chamber 36 is guided to the arc space via the through hole 42*b*, the pressure accumulating path 38, and the opening 61 between the outside of the guide portion 41 and the insulation nozzle 23. The arc-extinguishing gas is sprayed from the opening 61 to the arc space between the arc contactor (at the fixed side) 21 and the arc contactor (at the movable side) 41*a*.

The opening area S5 of the through hole 42*b* is equal to or larger than the fourth opening area S4. The opening area S4 that is the narrowest path diameter of the pressure accumulating path 38 is equal to or larger than the opening area S1 of the opening 61 between the outside of the guide portion 41 and the insulation nozzle 23.

$$S5 \geq S4 \geq S1 \quad \text{(Formula 2)}$$

Such a configuration enables the flow path cross-sectional area to be decreased toward the through hole 42*b* of the compression chamber 36, the pressure accumulating path 38, and the opening 61, and the arc-extinguishing gas is guided to the arc space between the arc contactor (at the fixed side) 21 and the arc contactor (at the movable side) 41*a* fluently. This can reduce the pressure loss of the arc-extinguishing gas and increase the gas density of the arc-extinguishing gas.

When the gas circuit breaker 1 becomes the opened state, the cylinder 42 compresses the arc-extinguishing gas in the compression chamber 36 in cooperation with the piston 33. After the pressurization of the arc-extinguishing gas in the compression chamber 36 has been completed or has advanced for a predetermined level, the insulation nozzle 23 and the trigger electrode 31 are separated from each other, and the arc-extinguishing gas in the compression chamber 36 which is pressurized by the piston 33 and the cylinder 42 is sprayed to the arc space between the arc contactor (at the fixed side) 21 and the trigger electrode 31 or the arc space between the arc contactor (at the fixed side) 21 and the arc contactor (at the movable side) 41*a*, via the pressure accumulating path 38. At this time, the high-temperature gas is discharged in the open-end direction through an internal space of the arc contactor (at the fixed side) 21 or a space formed by the arc contactor (at the fixed side) 21 and the insulation nozzle 23.

When the driving of the trigger electrode 31 further advances, the arc contactor (at the movable side) 41*a* and the trigger electrode 31 are separated from each other, and the arc-extinguishing gas in the compression chamber 36 which is pressurized by the piston 33 and the cylinder 42 is sprayed to the arc space between the arc contactor (at the fixed side) 21 and the arc contactor (at the movable side) 41*a* via the pressure accumulating path 38. At this time, the high-temperature gas is discharged through an internal space of the arc contactor (at the fixed side) 21 or a space formed by the arc contactor (at the fixed side) 21 and the insulation nozzle 23, and an internal space of the arc contactor (at the movable side) 41*a*.

In this way, the arc between the arc contactor (at the movable side) 41*a* and the arc contactor (at the fixed side) 21 is extinguished, so that the arc contactor (at the movable side) 41*a* and the arc contactor (at the fixed side) 21 are electrically disconnected from each other.

(Support 43)

The support 43 is a cylindrical conductor having a bottom in one end surface, and the bottom end surface is arranged at the device-end direction side. The lead-out conductor 7*b* is connected to the support 43 via the sealed container 8. The support 43 is fixed to the sealed container 8 by an insulation member. The support 43 supports the arc contactor (at the movable side) 41*a* and the cylinder 42.

(Movable Contactor Portion 3)

The movable contactor portion 3 includes the trigger electrode 31, the movable conductive contactor 32, the piston 33, and the insulation rod 37. Although, in the conventional technique, the movable contactor includes a nozzle, a cylinder, and an arc electrode, resulting in large size, the present embodiment can achieve significant weight reduction. It is not necessary that the trigger electrode 31 and the piston 33 are integrated and simultaneously operated, but when the trigger electrode 31 and the piston 33 are integrated, it is possible to simplify the structure. Note that in some cases, it is advantageous in terms of breaking performance to have a structure that the trigger electrode 31 is moved more rapidly than the piston 33.

(Movable Conductive Contactor 32)

The movable conductive contactor 32 is a cylindrical electrode arranged on an end of the movable contactor portion 3 at the open-end direction side along the center axis of the cylinder of the movable contactor portion 3.

The movable conductive contactor 32 is formed of a cylindrical metal conductor. An end of the movable conductive contactor 32 at the open-end direction side is formed into a chamfered curved shape. The movable conductive contactor 32 is preferably formed of aluminum having high electric conductivity and light weight, but may also be formed of copper. It is preferable that the movable conductive contactor 32 is reduced in weight to move.

The movable conductive contactor 32 has an outer diameter that contacts and is slidable with an inner diameter of the fixed conductive contactor 22 of the fixed contactor portion 2. The movable conductive contactor 32 is arranged on a surface of the piston 33 at the open-end direction side.

When the gas circuit breaker 1 is in the closed state, the movable conductive contactor 32 is inserted into the fixed conductive contactor 22 of the fixed contactor portion 2. Accordingly, the movable conductive contactor 32 contacts with the fixed conductive contactor 22, and the movable contactor portion 3 and the fixed contactor portion 2 are electrically connected to each other. The movable conductive contactor 32 has the capability of applying a rated current when being conducted.

On the other hand, when the gas circuit breaker 1 is in the opened state, the movable conductive contactor 32 is mechanically separated from the fixed conductive contactor 22 of the fixed contactor portion 2, and the movable contactor portion 3 and the fixed contactor portion 2 are electrically disconnected from each other.

The movable conductive contactor 32 is formed integrally with the piston 33 formed by the conductor. When the gas circuit breaker 1 is in the closed state and in the opened state, the piston 33 is inserted into the cylinder 42 of the fixed contactor portion 4, and the movable contactor portion 3 and the fixed contactor portion 4 are electrically connected to each other. The piston 33 slides in the cylinder 42 of the fixed contactor portion 4, and the movable contactor portion 3 and the fixed contactor portion 4 are electrically connected to each other regardless of whether the gas circuit breaker 1 is in the closed state or in the opened state.

(Trigger Electrode 31)

The trigger electrode 31 is a bar-shaped electrode arranged on an end of the movable contactor portion 3 at the open-end direction side along the center axis of the cylinder of the movable contactor portion 3. The trigger electrode 31 is formed of a solid metal conductor formed into a columnar shape by shaving, etc. An end of the trigger electrode 31 on the open-end direction side is formed into a chamfered curved shape. At least tip of the trigger electrode 31 is made of metal containing 10% to 40% of copper and 90% to 60% of tungsten, etc.

The trigger electrode 31 has an outer diameter that contacts and is slidable with an inner diameter of the arc contactor (at the fixed side) 21 of the fixed contactor portion 2. The trigger electrode 31 is arranged inside the arc contactor (at the movable side) 41*a*.

The trigger electrode 31 is connected to the insulation rod 37, together with the piston 33, and this insulation rod 37 is driven by the driving device 9 to reciprocate the trigger electrode 31 between the fixed contactor portion 2 and the fixed contactor portion 4. The trigger electrode 31 is movable relative to the arc contactor (at the fixed side) 21. The trigger electrode 31 is arranged in the arc-extinguishing gas, and bears the arc discharge generated in the arc-extinguishing gas.

When the gas circuit breaker 1 is in the closed state, the trigger electrode 31 is inserted into the arc contactor (at the fixed side) 21 of the fixed contactor portion 2. Accordingly, the trigger electrode 31 contacts with the arc contactor (at the fixed side) 21 of the fixed contactor portion 2 and with the arc contactor (at the movable side) 41*a* of the fixed contactor portion 4, and the fixed contactor portion 2, the movable contactor portion 3, and the fixed contactor portion 4 are electrically connected. When the gas circuit breaker 1 is in the closed state, the trigger electrode 31 forms a part of a current circuit that electrically connects the lead-out conductors 7*a* and 7*b* to each other.

When the gas circuit breaker 1 is in the closed state and in the first half of the current breaking action, the trigger electrode 31 closes the opening 62 of the insulation nozzle 23, so that the air tightness of the arc-extinguishing gas is ensured. In addition, when the gas circuit breaker 1 is in the closed state and in the first half of the current breaking action, the trigger electrode 31 closes the opening 63 of the arc contactor (at the movable side) 41*a* that is the guide portion so that the air tightness of the arc-extinguishing gas is ensured.

On the other hand, when the gas circuit breaker 1 becomes the opened state, the trigger electrode 31 is separated from the arc contactor (at the fixed side) 21 of the fixed contactor portion 2. Accordingly, the trigger electrode 31 bears the arc generated between the movable contactor portion 3 and the fixed contactor portion 2.

The trigger electrode 31 is separated from the arc contactor (at the fixed side) 21 after the movable conductive contactor 32 is separated from the fixed conductive contactor 22. Accordingly, the current to be broken is commutated to the trigger electrode 31 side and the arc contactor (at the fixed side) 21 side, so that the arc is not generated between the fixed conductive contactor 22 and the movable conductive contactor 32. The trigger electrode 31 forms a pair of electrodes arranged to face the arc contactor (on the fixed side) 21, and serves as one of electrodes that contact the arc when the gas circuit breaker 1 becomes the opened state.

The arc generated when the gas circuit breaker 1 is in the opened state concentrates between the trigger electrode 31 and the arc contactor (at the fixed side) 21. The arc can be prevented from being generated between the movable conductive contactor 32 and the fixed conductive contactor 22, reducing the degradation of the movable conductive contactor 32 and the fixed conductive contactor 22.

When the gas circuit breaker 1 becomes the opened state, the movable contactor portion 3 is driven by the driving device 9 to move between the arc contactor (at the fixed side) 21 and the arc contactor (at the movable side) 41*a* from the open-end direction side to the device-end direction side. Accordingly, the trigger electrode 31 also moves between the arc contactor (at the fixed side) 21 and the arc contactor (at the movable side) 41*a* from the open-end direction side to the device-end direction side. The fixed conductive contactor 22 and the movable conductive contactor 32 are separated from each other before the trigger electrode 31 is separated from the arc contactor (at the fixed side) 21. This prevents the arc from being generated between the fixed conductive contactor 22 and the movable conductive contactor 32.

The arc is generated between the trigger electrode 31 and the arc contactor (at the fixed side) 21 from a time point when the trigger electrode 31 starts to separate from the arc contactor (at the fixed side) 21 until when the separation distance between the arc contactor (at the fixed side) 21 and the arc contactor (at the movable side) 41*a* becomes equal to the separation distance between the arc contactor (at the fixed side) 21 and the trigger electrode 31.

When the separation distance between the arc contactor (at the fixed side) 21 and the arc contactor (at the movable side) 41*a* becomes equal to the separation distance between the arc contactor (at the fixed side) 21 and the trigger electrode 31, the arc is transferred from the trigger electrode 31 to the arc contactor (at the movable side) 41*a*. The arc is generated between the arc contactor (at the movable side) 41*a* and the arc contactor (at the fixed side) 21 from a time point when the separation distance between the arc contactor (at the fixed side) 21 and the arc contactor (at the movable side) 41*a* becomes equal to the separation distance between the arc contactor (at the fixed side) 21 and the trigger electrode 31 until the arc is extinguished. At this time, the arc contactor (at the movable side) 41*a* and the arc contactor (at the fixed side) 21 form a pair of electrodes that are arranged to face each other, and bear the arc.

The trigger electrode 31 further moves in the device-end direction, that is, in a direction in which the separation distance between the arc contactor (at the fixed side) 21 and the trigger electrode 31 becomes larger than the separation distance between the arc contactor (at the fixed side) 21 and the arc contactor (at the movable side) 41*a*. This causes the trigger electrode 31 to separate from the arc generated between the arc contactor (at the movable side) 41*a* and the arc contactor (at the fixed side) 21, reducing the degradation of the trigger electrode 31.

The trigger electrode 31 furthermore moves in the device-end direction. In the latter half of the current breaking action, the trigger electrode 31 is separated from the opening 62 of the insulation nozzle 23, to open the opening 62 is opened. In addition, in the latter half of the current breaking action, the trigger electrode 31 is separated from the opening 63 of the arc contactor (at the movable side) 41*a*, to open the opening 63 is opened. When the opening 62 and the opening 63 are opened, the arc-extinguishing gas pressurized in the compression chamber 36 is guided to the arc space. The arc-extinguishing gas pressurized in the compression chamber 36 formed by the piston 33 and the cylinder 42 is sprayed via the pressure accumulating path 38 and the insulation nozzle 23, and the arc between the arc contactor (at the fixed side) 21 and the arc contactor (at the movable side) 41*a* is extinguished.

In this way, the arc between the arc contactor (at the movable side) 41*a* and the arc contactor (at the fixed side) 21 is extinguished, and the arc contactor (on the movable side) 41*a* and the arc contactor (at the fixed side) 21 are electrically disconnected from each other. After the arc is extinguished, the arc current does not flow in the trigger electrode 31.

The movement of the trigger electrode 31 relative to the arc contactor (at the fixed side) 21 and the arc contactor (at the movable side) 41*a* is caused by the insulation rod 37 that is fixed to and supported by the trigger electrode 31 and the piston 33. The insulation rod 37 is driven by the driving device 9. The insulation rod 37 is made of an insulating material. The insulation rod 37 is arranged on the center axes of the trigger electrode 31, the arc contactor (at the fixed side) 21, and the arc contactor (at the movable side) 41*a*.

(Piston 33)

The piston 33 is a torus-shaped plate arranged on an end surface of the movable contactor portion 3 at the open-end direction side of the movable contactor. The piston includes the movable conductive contactor 32 on a surface on the open-end direction side. The piston 33 is formed of a metal conductor formed into a torus-shaped plate by shaving, etc.

The piston 33 has an outer diameter that is slidable with an inner diameter of the outer wall 51 of the cylinder 42 of the fixed contactor portion 4. The piston 33 has a hole diameter of the torus-shaped that is slidable with the inner wall 52 of the cylinder 42 of the fixed contactor portion 4.

The piston 33 includes a plurality of piston supports 33*a* connected to the surface at the device-end direction side. The piston support 33*a* is a member that is formed by a metal conductor formed into a rod shape. The piston supports 33*a* fix the piston 33 to the trigger electrode 31 via the insertion hole 42*a* of the cylinder 42. The piston 33 is connected to the insulation rod 37 via the piston supports 33*a* and the trigger electrode 31.

The piston 33 is slidably inserted into and arranged in the cylinder 42 of the fixed contactor portion 4. The compression chamber 36 for pressurizing the arc-extinguishing gas is formed by the piston 33 and the cylinder 42. The piston 33 is arranged in the arc-extinguishing gas.

The piston 33 reciprocates by the driving device 9 connected via the insulation rod 37. The reciprocation by the driving device 9 is performed when the gas circuit breaker 1 becomes the closed state and becomes the opened state.

When the gas circuit breaker 1 becomes the opened state, the piston 33 compresses the arc-extinguishing gas in the compression chamber 36 in cooperation with the cylinder 42. As a result, the arc-extinguishing gas in the compression chamber 36 is pressurized.

The pressure accumulating path 38 communicates with the compression chamber 36 through the through hole 42*b* provided in the cylinder 42. In the stage in which the arc-extinguishing gas in the compression chamber 36 is pressurized by the piston 33 and the cylinder 42, the pressure leak of the pressure accumulating path 38 is prevented. Accordingly, the arc-extinguishing gas pressurized to the same pressure is filled in the compression chamber 36 and the pressure accumulating passage 38.

In addition, in the stage in which the arc-extinguishing gas in the compression chamber 36 is pressurized, since the opening 62 of the insulation nozzle 23 and the opening 63 of the arc contactor (at the movable side) 41*a* are closed by the trigger electrode 31, the compression chamber 36 formed by the piston 33 and the cylinder 42 and the pressure accumulating oath 38 are in a state in which the air tightness of the arc-extinguishing gas is ensured and are separated from the arc. Since the arc-extinguishing gas is less affected by the heat of the arc, the pressurized arc-extinguishing gas in the compression chamber 36 and the pressure accumulating path 38 has a low temperature. The arc-extinguishing gas having a low temperature is sprayed to the arc between the arc contactor (at the movable side) 41*a* and the arc contactor (at the fixed side) 21, and the arc is efficiently extinguished.

In the latter half of the current breaking action in which the pressurization of the arc-extinguishing gas in the compression chamber 36 has been completed or has advanced for a predetermined level, the trigger electrode 31 is separated from the opening 62 of the insulation nozzle 23 and the opening 63 of the arc contactor (at the movable side) 41*a*, to open the opening 62 and the opening 63. In this way, the arc-extinguishing gas in the compression chamber 36 which is pressurized by the piston 33 and the cylinder 42 is sprayed to the arc space between the arc contactor (at the fixed side) 21 and the arc contactor (at the movable side) 41*a* via the pressure accumulating path 38.

As a result, the arc between the arc contactor (at the movable side) 41*a* and the arc contactor (at the fixed side) 21 is extinguished, and the arc contactor (at the movable side) 41*a* and the arc contactor (on the fixed side) 21 are electrically disconnected from each other.

The heat by the arc generated between the arc contactor (at the fixed side) 21 and the trigger electrode 31 or between the arc contactor (at the fixed side) 21 and the arc contactor (at the movable side) 41*a*, and the arc-extinguishing gas that is heated to a high temperature by the arc pass through the exhaust ports 24*a*, 24*b*, and 44, and are exhausted into the sealed container 8 rapidly.

(Insulation Rod 37)

The insulation rod 37 is a bar-shaped member made of the insulating material. The trigger electrode 31 and the piston 33 are fixed to the open-end direction side of the insulation rod 37. The device-end direction side of the insulation rod 37 is connected to the driving device 9.

The insulation rod 37 is arranged on the center axes of the trigger electrode 31, the arc contactor (at the fixed side) 21, and the arc contactor (at the movable side) 41*a*. The trigger electrode 31 stands on the end portion of the insulation rod 37 at the open-end direction side. The insulation rod 37 reciprocates by the driving device 9 when the gas circuit breaker 1 becomes the closed state and becomes the opened state.

The above is the configuration of the gas circuit breaker 1.

[1-3. Action]

Next, the action of the gas circuit breaker 1 of the present embodiment will be described based on FIGS. 1 to 8.

[A. A Case where the Gas Circuit Breaker 1 is in the Closed State]

Firstly, a case where the gas circuit breaker 1 of the present embodiment is in the closed state will be described. When in the closed state, the gas circuit breaker 1 conducts the current flowing in the lead-out conductors 7*a* and 7*b*.

In the case where the gas circuit breaker 1 of the present embodiment is in the closed state, the fixed contactor portion 2 and the fixed contactor portion 4 are electrically connected to each other via the movable contactor portion 3, and the current flows between the lead-out conductors 7*a* and 7*b*. Specifically, the movable conductive contactor 32 of the movable contactor portion 3 is inserted into the fixed conductive contactor 22 of the fixed contactor portion 2. In this way, the fixed conductive contactor 22 contacts with the movable conductive contactor 32, and the fixed contactor portion 2 and the movable contactor portion 3 are brought into an electrically conductive state.

In addition, the trigger electrode 31 of the movable contactor portion 3 is inserted into the arc contactor (at the fixed side) 21 of the fixed contactor portion 2. In this way, the arc contactor (at the fixed side) 21 contacts the trigger electrode 31, and the fixed contactor portion 2 and the movable contactor portion 3 are brought into an electrically conductive state.

Furthermore, the piston 33 of the movable contactor portion 3 is inserted into the cylinder 42 of the fixed contactor portion 4. The piston 33 and the movable conductive contactor 32 are formed integrally with each other and are electrically connected to each other. This enables the movable conductive contactor 32 to be electrically connected to the cylinder 42, and the fixed contactor portion 4 and the movable contactor portion 3 are brought into an electrically conductive state.

As a result, the fixed contactor portion 2 and the fixed contactor portion 4 are electrically connected to each other via the movable contactor portion 3, and the lead-out conductors 7*a* and 7*b* are brought into an electrically conductive state.

In this state, the arc is not generated in the space between the trigger electrode 31 or the arc contactor (at the movable side) 41*a* and the arc contactor (at the fixed side) 21. In addition, the pressure of the arc-extinguishing gas is uniformly applied to each portion in the sealed container 8. Accordingly, the arc-extinguishing gas in the compression chamber 36 formed by the piston 33 of the movable contactor portion 3 and the cylinder 42 of the fixed contactor portion 4 is not pressurized. In addition, the arc-extinguishing gas in the pressure accumulating passage 38 is also not pressurized.

The opening 62 of the insulation nozzle 23 and the opening 63 of the arc contactor (at the movable side) 41*a* are closed by the trigger electrode 31, so that the air tightness of the arc-extinguishing gas is ensured.

When the gas circuit breaker 1 is in the closed state, the pressure of the arc-extinguishing gas in the sealed container 8 is uniform. Accordingly, the gas flow caused by the arc-extinguishing gas is not generated.

[B. A Case where the Gas Circuit Breaker 1 Becomes the Opened State]

Next, a case where the gas circuit breaker 1 of the present embodiment becomes the opened state will be described. The gas circuit breaker 1 is in the opened state, and the current flowing between the lead-out conductors 7*a* and 7*b* is broken.

The breaking operation to open the gas circuit breaker 1 to be the opened state is performed when the gas circuit breaker 1 is switched from the conductive state to the breaking state at a time of breaking a fault current or a load current or switching a power transmission circuit.

When the gas circuit breaker 1 is switched from the closed state to the opened state, the driving device 9 is driven. The movable contactor portion 3 is moved by the driving device 9 along the axis in the fixed contactor portion 4 in the device-end direction. In this way, the movable conductive contactor 32 is separated from the fixed conductive contactor 22, and the trigger electrode 31 is separated from the arc contactor (at the fixed side) 21.

When the gas circuit breaker 1 becomes the opened state, the movable contactor portion 3 is driven by the driving device 9 to move between the fixed contactor portion 2 and the fixed contactor portion 4 from the open-end direction side to the device-end direction side.

Accordingly, the movable conductive contactor 32 is separated from the fixed conductive contactor 22, and moves from the open-end direction side to the device-end direction side.

Furthermore, the trigger electrode 31 also moves between the arc contactor (at the fixed side) 21 and the arc contactor (at the movable side) 41*a* from the open-end direction side to the device-end direction side. After the movable conductive contactor 32 is separated from the fixed conductive contactor 22, the trigger electrode 31 is separated from the arc contactor (at the fixed side) 21. In this way, the current to be broken is commutated to the trigger electrode 31 side and the arc contactor (at the fixed side) 21 side, so that the arc is not generated between the fixed conductive contactor 22 and the movable conductive contactor 32.

The arc is generated between the trigger electrode 31 and the arc contactor (at the fixed side) 21 from a time point when the trigger electrode 31 starts to separate from the arc contactor (at the fixed side) 21 until when the separation distance between the arc contactor (at the fixed side) 21 and the arc contactor (at the movable side) 41*a* becomes equal to the separation distance between the arc contactor (at the fixed side) 21 and the trigger electrode 31.

When the separation distance between the arc contactor (at the fixed side) 21 and the arc contactor (at the movable side) 41*a* becomes equal to the separation distance between the arc contactor (at the fixed side) 21 and the trigger electrode 31, the arc is transferred from the trigger electrode 31 to the arc contactor (at the movable side) 41*a*. The arc is generated between the arc contactor (at the movable side) 41*a* and the arc contactor (at the fixed side) 21 from a time point when the separation distance between the arc contactor (at the fixed side) 21 and the arc contactor (at the movable side) 41*a* becomes equal to the separation distance between the arc contactor (at the fixed side) 21 and the trigger electrode 31 until the arc is extinguished. At this time, the arc contactor (at the movable side) 41*a* and the arc contactor (at the fixed side) 21 form a pair of electrodes that are arranged to face each other, and bear the arc.

The trigger electrode 31 further moves in the device-end direction, that is, in a direction in which the separation distance between the arc contactor (at the fixed side) 21 and the trigger electrode 31 becomes larger than the separation distance between the arc contactor (at the fixed side) 21 and the arc contactor (at the movable side) 41*a*. This causes the trigger electrode 31 to separate from the arc generated between the arc contactor (at the movable side) 41*a* and the arc contactor (at the fixed side) 21, reducing the degradation of the trigger electrode 31.

Since the movable contactor portion 3 is driven by the driving device 9 when the gas circuit breaker 1 becomes the opened state, the piston 33 also moves from the open-end direction side to the device-end direction side. The piston 33 compresses the arc-extinguishing gas in the compression chamber 36 in cooperation with the cylinder 42. As a result, the arc-extinguishing gas in the compression chamber 36 is pressurized.

The trigger electrode 31 is driven by the driving device 9 to further move in the device-end direction. In the latter half of the current breaking action, the trigger electrode 31 is separated from the insulation nozzle 23, to open the opening 62 of the insulation nozzle 23. In addition, in the latter half of the current breaking action, the trigger electrode 31 is separated from the opening 63 of the arc contactor (at the movable side) 41*a*, to open the opening 63. When the opening 62 and the opening 63 are opened, the arc-extinguishing gas pressurized in the compression chamber 36 is guided to the arc space.

The through hole 42*b* is provided in the inner wall 52 of the cylinder 42 forming the compression chamber 36. The through hole 42*b* connects the compression chamber 36 and the pressure accumulating path 38. The through hole 42*b* has the opening area S5. The pressure accumulating path 38 has a constant opening area S4. The opening area S4 of the pressure accumulating path 38 may have an opening area which gradually decreases from S5 toward S1.

In the latter half of the current breaking action, the sealing of the insulation nozzle 23 by the trigger electrode 31 is opened, and the arc-extinguishing gas pressurized in the compression chamber 36 is guided to the arc space via the through hole 42*b*, the pressure accumulating path 38, and the opening 61 between the outside of the guide portion 41 and the insulation nozzle 23.

The opening area S5 of the through hole 42*b* is equal to or larger than the fourth opening area S4. The opening 61 having the opening area S1 is formed between the outside of the guide portion 41 and the insulation nozzle 23. The opening area S4 which is the narrowest path diameter of the pressure accumulating path 38 is equal to or larger than the opening area S1 of the opening 61 between the outside of the guide portion 41 and the insulation nozzle 23.

$$S5 > S4 + S1 \quad \text{(Formula 2)}$$

Such a configuration enables the flow path cross-sectional area to be decreased toward the through hole 42*b* of the compression chamber 36, the pressure accumulating path 38, and the opening 61, and the arc-extinguishing gas is guided to the arc space between the arc contactor (at the fixed side) 21 and the arc contactor (at the movable side) 41*a* fluently. This can reduce the pressure loss of the arc-extinguishing gas and increase the gas density of the arc-extinguishing gas.

The opening 62 having the opening area S2 is formed inside the insulation nozzle 23. The opening 63 having the opening area S3 is formed inside the arc contactor (at the movable side) 41*a*. The sum of the opening area S2 of the opening 62 and the opening area S3 of the opening 63 is less than the opening area S1 of the opening 61.

$$S1 > S2 + S3 \quad \text{(Formula 1)}$$

When the opening area S1 of the opening 61 which is at an upstream side of the arc-extinguishing gas flow is thus larger than the sum of the opening area S1 of the opening 62 and the opening area S3 of the opening 63 which are at a downstream side of the arc-extinguishing gas flow, the arc-extinguishing gas is guided to the arc space between the arc contactor (at the fixed side) 21 and the arc contactor (at the movable side) 41*a* fluently. This can reduce the pressure loss of the arc-extinguishing gas and increase the gas density of the arc-extinguishing gas. The arc-extinguishing gas is sprayed at a high velocity from the opening 61 to the arc space between the arc contactor (at the fixed side) 21 and the arc contactor (at the movable side) 41*a*, and the arc between the arc contactor (at the fixed side) 21 and the arc contactor (at the movable side) 41*a* is extinguished.

The arc-extinguishing gas that has passed through the arc space passes through the opening 62 formed inside the insulation nozzle 23 and the opening 63 formed inside the arc contactor (ay the movable side) 41*a*, and is discharged to a large space filled with the low-pressure arc-extinguishing gas. Accordingly, the arc-extinguishing gas flows faster.

The arc contactor (at the movable side) 41*a* and the arc contactor (at the fixed side) 21 are electrically disconnected by extinguishing the arc between the arc contactor (at the movable side) 41*a* and the arc contactor (at the fixed side) 21.

In general, the following relation is held among a pressure P, a density p, and a temperature T of the arc-extinguishing gas. R is a gas constant inherent to each gas type.

$$=\rho RT \quad \text{(Formula 3)}$$

To reduce the cost of the gas circuit breaker, it is preferable to achieve high arc-extinguishing performance with lower drive operation force. However, in the conventional puffer-type gas circuit breaker and thermal puffer-type gas circuit breaker, exhaust heat gas from the arc flows into a puffer chamber, and hence, the pressurized arc-extinguishing gas inevitably becomes a high temperature to obtain the sufficient gas density of the gas.

In the conventional puffer-type gas circuit breaker and thermal puffer-type gas circuit breaker, the spray gas is pressurized using the energy of the hot gas, and the spray gas inevitably becomes a high temperature, which causes decrease in the density. To increase the density of the arc-extinguishing gas, a large driving force is required, and consequently the driving device becomes large.

In order to solve this problem, another conventional technique can produce the high-density arc-extinguishing gas in the pressure accumulating chamber without taking in the exhaust heat gas from the arc, even under the relatively low pressure. However, the high-density arc-extinguishing gas produced in the pressure accumulating chamber is accelerated by increasing or decreasing the flow path cross-sectional area, and then is sprayed to the arc at a high velocity. Accordingly, a part of internal energy of the high-density arc-extinguishing gas in the pressure accumulating chamber is converted into kinetic energy, and the gas density of the arc-extinguishing gas contributing to the cooling of the arc decreases compared with that in the pressure accumulating chamber.

According to the present embodiment, when the gas circuit breaker 1 is in the closed state and in the first half of the current breaking action, the opening 62 of the insulation nozzle 23 and the opening 63 of the arc contactor (at the movable side) 41*a* that is the guide portion 41 are closed by the trigger electrode 31, so that the air tightness of the arc-extinguishing gas is ensured. This can prevent the arc-extinguishing gas that has become a high temperature from entering the compression chamber 36 and the pressure accumulating path 38. As a result, the arc-extinguishing gas is compressed at a low temperature in the compression chamber 36, whereby the pressure and density of the arc-extinguishing gas to be sprayed to the arc can be appropriately ensured.

Furthermore, according to the present embodiment, S2+S3 is formed as the narrowest path portion in the entire passage. Therefore, S2+S3 corresponds to a throat of a so-called Laval nozzle, and the density at the upstream side of S2 and S3 remains high, whereby the high-density gas can be sprayed to the arc.

The end of the insulation nozzle 23 at the device-end direction side is joined to the inner wall 52 of the cylinder 42. Th insulation nozzle 23 is supported by the inner wall 52 of the cylinder 42.

In the position where the distance between the arc contactor (at the fixed side) 21 and the arc contactor (at the movable side) 41*a* is substantially equal to the distance between the arc contactor (at the fixed side) 21 and the joining portion between the insulation nozzle 23 and the inner wall 52, the insulation nozzle 23 is joined to the inner wall 52 of the cylinder 42. The inner wall 52 is made of a conductive material, and has the same potential as the movable conductive contactor 32, thereby preventing steepening of a potential gradient between the fixed conductive contactor 22 and the movable conductive contactor 32.

This can reduce the possibility that the dielectric breakdown occurs at the triple junction (triple point) in the joining portion between the insulation nozzle 23 and the inner wall 52 of the cylinder 42.

The arc-extinguishing gas to be sprayed to the arc space between the arc contactor (at the fixed side) 21 and the arc contactor (at the movable side) 41*a* is pressurized by the piston 33 and the cylinder 42. In addition, the arc space between the arc contactor (at the fixed side) 21 and the arc contactor (at the movable side) 41*a* has reached a high temperature. The insulation nozzle 23 guides, to the arc space, the high-temperature arc-extinguishing gas that has been highly pressurized, at a high flow speed.

Therefore, the insulation nozzle 23 may be deformed. The high-temperature arc-extinguishing gas that has been highly pressurized may cause the inner diameter of the insulation nozzle 23 to expand. If the inner diameter of the insulation nozzle 23 is expanded, the arc-extinguishing gas cannot be guided to the arc space at a high speed, which may make it impossible to break the current surely.

The gas circuit breaker pressurizes the arc-extinguishing gas, and sprays the pressurized arc-extinguishing gas to the arc to extinguish the arc. Accordingly, it is not preferable that the pressure of the pressurized arc-extinguishing gas decreases and the spraying velocity of the arc-extinguishing gas is reduced when the arc-extinguishing gas is sprayed to the arc. This is because the pressure decrease of the pressurized arc-extinguishing gas causes reduction in the flow speed of the arc-extinguishing gas, which makes it hard to surely extinguish the arc.

However, in the gas circuit breaker 1 according to the present embodiment, in the position where the distance between the arc contactor (at the fixed side) 21 and the arc contactor (at the movable side) 41*a* is substantially equal to the distance between the arc contactor (at the fixed side) 21 and the joining portion between the insulation nozzle 23 and the inner wall 52, the insulation nozzle 23 is joined to the inner wall 52 of the cylinder 42. The inner wall 52 is made of a conductive material, and has the same potential as the movable conductive contactor 32, thereby preventing steepening of a potential gradient between the fixed conductive contactor 22 and the movable conductive contactor 32.

This reduces the deformation of the insulation nozzle 23. Accordingly, the opening area S2 of the opening 62 of the insulation nozzle 23 is appropriately maintained. The deformation of the insulation nozzle 23 is reduced, and the opening area S2 of the opening 62 is appropriately maintained, which makes it possible to prevent deterioration of the air tightness of the arc-extinguishing gas and prevent the arc-extinguishing gas that has become a high temperature from entering the compression chamber 36 and the pressure accumulating passage 38. As a result, the arc-extinguishing gas is compressed at a low temperature in the compression chamber 36, whereby the pressure and density of the arc-extinguishing gas to be sprayed to the arc can be appropriately ensured.

The arc generated in the arc space between the arc contactor (at the fixed side) 21 and the arc contactor (at the movable side) 41*a* becomes a high temperature. The arc-extinguishing gas that has been sprayed to the arc and become a high temperature is discharged from exhaust ports 24*a*, 24*b*, and 44 of the exhaust cylinder 24 into the sealed container 8.

The arc between the arc contactor (at the fixed side) 21 and the arc contactor (at the movable side) 41*a* is reduced in size at a current zero cross point of an alternating current supplied from the lead-out conductors 7*a* and 7*b*, and is extinguished by spraying the arc-extinguishing gas. As a result, the gas circuit breaker 1 becomes the opened state, and the current flowing in the lead-out conductors 7*a* and 7*b* are broken.

The above is an action of the gas circuit breaker 1.

[1-4. Effect]

(1) According to the present embodiment, the gas circuit breaker 1 that includes the first arc contactor 21 electrically connected to a first lead-out conductor 7*a* connected to a power system, the cylindrical guide portion 41 provided on a second lead-out conductor 7*b* side, the trigger electrode 31 which is arranged to be movable between the first arc contactor 21 and the guide portion 41 and which ignites an arc generated between the first arc contactor 21 and the trigger electrode along with a movement in a first half of a current breaking action, the compression chamber 36 for pressurizing arc-extinguishing gas, the compression chamber 36 formed by the cylinder 42 which has the outer wall 51 and the inner wall 52, each being formed in a cylindrical shape, and which is provided on the guide portion 41 side, and the piston 33 which slides between the outer wall 51 and the inner wall 52 in conjunction with the trigger electrode 31, and the insulation nozzle 23 which guides the arc-extinguishing gas pressurized in the compression chamber 36 to an arc ignited at the first arc contactor 21 can be provided, and since the insulation nozzle 23 is formed integrally with the inner wall 52 of the cylinder 42, the deformation of the insulation nozzle 23 and the leakage of the arc-extinguishing gas compressed to be sprayed to the arc can be reduced, the pressure and density of the arc-extinguishing gas to be sprayed to the arc can be appropriately ensured, and the electric insulation performance can be more surely maintained.

In the case where the insulation nozzle 23 is not formed integrally with the inner wall 52 of the cylinder 42, the insulation nozzle 23 is deformed in the outer circumferential direction when spraying the high-pressure arc-extinguishing gas that has reached a high temperature. This causes the leakage of the arc-extinguishing gas, resulting in the reduction in pressure of the arc-extinguishing gas. As a result, the breaking performance and electric insulation performance of the gas circuit breaker 1 decrease.

However, according to the present embodiment, since the insulation nozzle 23 of the gas circuit breaker is formed integrally with the inner wall 52 of the cylinder 42, the deformation of the insulation nozzle 23 is suppressed even when the high-pressure arc-extinguishing gas that has reached a high temperature is sprayed. This reduces the leakage of the arc-extinguishing gas. As a result, the pressure decrease of the arc-extinguishing gas is suppressed, and the breaking performance and electric insulation performance of the gas circuit breaker 1 are more surely maintained.

(2) According to the present embodiment, when the gas circuit breaker 1 is in the closed state and in the first half of the current breaking action, the opening 62 of the insulation nozzle 23 and the opening 63 of the arc contactor (at the movable side) 41*a*, are closed by the trigger electrode 31, so that the air tightness of the arc-extinguishing gas is ensured, and the arc-extinguishing gas that has become a high temperature can be prevented from entering the compression chamber 36 and the pressure accumulating path 38. As a result, the gas circuit breaker 1 can be provided in which the arc-extinguishing gas is compressed at a low temperature in the compression chamber 36, whereby the pressure and density of the arc-extinguishing gas to be sprayed to the arc can be appropriately ensured.

The gas circuit breaker 1 that can be achieved by the small driving device 9 without requiring a large driving force for breaking of the gas circuit breaker 1 can be provided. Furthermore, the gas circuit breaker 1 having both of excellent breaking performance and durability can be achieved with a simple structure.

(3) Since the opening area S1 of the opening 61 which is at an upstream side of the arc-extinguishing gas flow is larger than the sum of the opening area S2 of the opening 62 and the opening area S3 of the opening 63 which are at a downstream side of the arc-extinguishing gas flow, the arc-extinguishing gas is guided to the arc space between the arc contactor (at the fixed side) 21 and the arc contactor (at the movable side) 41*a* fluently. As a result, the gas circuit breaker 1*c* which the pressure and density of the arc-extinguishing gas to be sprayed to the arc are appropriately ensured can be provided.

In the path in which the arc-extinguishing gas flows, the sum of the opening area S2 of the opening 62 and the opening area S3 of the opening 63 is small, and serves as the throat with respect to a so-called entire path. Therefore, the flow speed of the arc-extinguishing gas exceeds the speed of the sound at the downstream side of the throat, and the gas density decreases. However, the gas density of the arc-extinguishing gas remains high at the upstream side of the throat. Accordingly, in the region surrounded by the opening 61, the opening 62, and the opening 63, the arc-extinguishing gas has high density, whereby a stagnation point is formed in which the flow is not fluent.

Since the stagnation point is formed in the arc generation portion, the high-pressure and high-density arc-extinguishing gas can be sprayed to the arc. The temperature of the arc-extinguishing gas to be sprayed can be lowered and the density can be increased compared to those in the conventional gas circuit breaker. The high arc-extinguishing performance can be achieved with the low-pressure arc-extinguishing gas. As a result, the gas circuit breaker 1 that can be achieved by the small driving device 9 without requiring a large driving force can be provided.

In the gas circuit breaker in the conventional technique, the compressed arc-extinguishing gas passes through the throat having a narrow flow path cross-sectional area and is sprayed to the arc. Therefore, a portion where the gas density of the arc-extinguishing gas is the highest is located outside the region where the arc is generated. Accordingly, the stagnation point where the density of the spray gas is the highest is formed outside the region where the arc is generated.

However, according to the present embodiment, the opening area S2 of the opening 62 formed in the inner diameter of the insulation nozzle 23 and the opening area S3 of the opening 63 formed in the inner diameter of the guide portion 41 depend on the size of the trigger electrode 31, but the opening area S1 of the opening 61 between the outside of the guide portion 41 and the insulation nozzle 23 does not depend on the size of the trigger electrode 31 and can be selected independently. Accordingly, the opening area S1 of the opening 61 can be larger than the sum of the opening area S2 of the opening 62 and the opening area S3 of the opening 63.

Therefore, the region surrounded by the opening 61, the opening 62, and the opening 63 can serve as the stagnation point, whereby the arc-extinguishing gas can be made high density. Accordingly, the density of the arc-extinguishing gas required for breaking can be achieved with a lower pressure, and the gas circuit breaker 1 can be achieved by the small driving device 9.

(4) According to the present embodiment, the opening area S5 of the through hole 42*b* provided in the inner wall 52 of the cylinder 42 is equal to or larger than the opening area S4 which is the narrowest path diameter of the pressure accumulating path 38. The opening area S4 which is the narrowest path diameter of the pressure accumulating path 38 is equal to or larger than the opening area S1 of the opening 61 between the outside of the guide portion 41 and the insulation nozzle 23. By such a configuration, the flow path cross-sectional area gets smaller in order of the through hole 42*b* of the compression chamber 36, the pressure accumulating passage 38, and the opening 61, and the arc-extinguishing gas is guided to the arc space between the arc contactor (at the fixed side) 21 and the arc contactor (at the movable side) 41*a* fluently. This can reduce the pressure loss of the arc-extinguishing gas and increase the gas density of the arc-extinguishing gas.

(5) According to the present embodiment, since the guide portion 41 is the second arc contactor 41*a* in which an arc is ignited by the trigger electrode 31 in the latter half of the current breaking action, the arc is commutated to the arc contactor (at the movable side) 41*a* when the trigger electrode 31 approaches the arc contactor (at the movable side) 41*a* in the latter half of the current breaking action. The trigger electrode 31 is easily damaged by heat from the arc, but since the arc is commuted from the trigger electrode 31 to the arc contactor (at the movable side) 41*a*, a time period during which the arc is ignited at the trigger electrode 31 can be reduced. Accordingly, the damage of the trigger electrode 31 by the arc can be suppressed, and the lifetime of the trigger electrode 31 can be extended.

Since the arc contactor (at the movable side) 41*a* is not driven by the driving device 9 and does not affect a weight of a movable component, the arc contactor (at the movable side) 41*a* can be formed thicker without considering an increase in weight. Therefore, the durability against the large-current arc can be remarkably improved.

(6) According to the present embodiment, since the guide portion 41 is a rectifier which is made of an insulating material and which rectifies and guides the arc-extinguishing gas toward the driving-device direction side, the guide portion 41 can be formed of a light-weight member.

(7) According to the present embodiment, the insulation nozzle 23 is made of an insulating material and is supported by the inner wall 52 of the cylinder 42 made of a conductive material. The inner wall 52 is made of a conductive material, has the same potential as the movable conductive contactor 32 can prevent the steepening of a potential gradient between the fixed conductive contactor 22 and the movable conductive contactor 32. This can reduce the possibility that the dielectric breakdown occurs at the triple junction (triple point) in the joining portion between the insulation nozzle 23 and the inner wall 52 of the cylinder 42.

As a result, the possibility that the dielectric breakdown occurs at the joining portion between the insulation nozzle 23 and the inner wall 52 of the cylinder 42 can be reduced, and the breaking performance and electric insulation performance of the gas circuit breaker 1 can be more surely maintained.

If the arc contactor (at the movable side) 41*a* as the guide portion 41 is made of a conductive material, and the insulation nozzle 23 and the inner wall 52 of the cylinder 42 are made of an insulating material, it is necessary to increase the distance between the insulation nozzle 23 and the arc contactor (at the movable side) 41*a* to prevent the electric field intensity around the trigger electrode 31 and the arc contactor (at the movable side) 41*a* from being increased, whereby the gas circuit breaker 1 may become large.

According to the present embodiment, since the insulation nozzle 23 is made of an insulating material and the inner wall 52 of the cylinder 42 is made of a conductive material, the electric field intensity around the trigger electrode 31 and the arc contactor (at the movable side) 41*a* as the guide portion 41 can be reduced while maintaining electrical insulation between the fixed contactor portion 2 and the fixed contactor portion 4, which can prevent the gas circuit breaker 1 from becoming large.

If the guide portion 41 is made of an insulating material, the electric field intensity around the trigger electrode 31 and the guide portion is increased, which may prevent the apparatus from being compact. According to the present embodiment, since the insulation nozzle 23 is made of an insulating material and the inner wall 52 of the cylinder 42 is made of a conductive material, the electric field intensity around the trigger electrode 31 and the guide portion can be reduced while maintaining electrical insulation between the fixed contactor portion 2 and the fixed contactor portion 4, which can prevent the gas circuit breaker 1 from becoming large.

According to the present embodiment, since the inner wall 52 of the cylinder 42 which is a sliding surface between the piston 33 and the inner wall 52 is made of a metal material, high mechanical strength can be achieved with thinner material compared to the case in which the inner wall 52 is made of an insulating material, which can prevent the gas circuit breaker 1 from becoming large.

[2. Second Embodiment]

[2-1. Configuration and Action]

Figure 10:
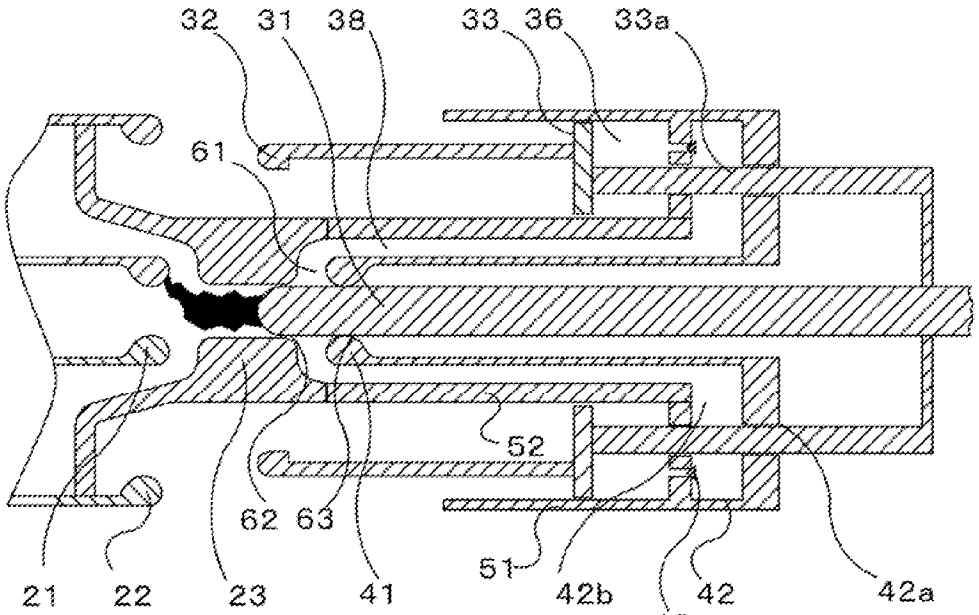
FIG. 10 is a diagram illustrating a gas circuit breaker according to a second embodiment including a valve in a cylinder.

In a gas circuit breaker 1 of the present embodiment, a cylinder 42 includes a check valve 42*e*, in addition to the first embodiment. Other components are identical to those in the first embodiment. A configuration and action of the gas circuit breaker 1 of the present embodiment will be described with reference to FIG. 10. The check valve 42*e* closes between the compression chamber 36 and the pressure accumulating path 38 when the pressure of the arc-extinguishing gas in the compression chamber 36 is equal to or larger than a predetermined value.

In the current breaking action, the arc-extinguishing gas is compressed in the compression chamber 36 formed by the piston 33 and the cylinder 42. When the arc-extinguishing gas is compressed, a force to prevent the pressurization, that is, a force to reversely move the piston 33 toward the open-end direction side is generated in the compression chamber 36.

If the force to reversely move the piston 33 to the open-end direction side becomes larger than the force to pull the piston 33 by the driving device, the piston 33 moves reversely, and the arc-extinguishing gas is not compressed.

In this case, the piston 33 is mechanically connected to the trigger electrode 31, and therefore the trigger electrode 31 also moves reversely. This prevents the trigger electrode 31 from being separated from the opening 62 of the insulation nozzle 23, and the opening 62 is maintained in the closed state by the trigger electrode 31. In addition, the trigger electrode 31 is prevented from being separated from the opening 63 of the guide portion 41, and the opening 63 is maintained in the closed state by the trigger electrode 31. As a result, the arc-extinguishing gas in an amount sufficient to extinguish the arc is prevented from being sprayed from the opening 61 formed between the outside of the guide portion 41 and the insulation nozzle 23. When the spray amount of the arc-extinguishing gas is insufficient, it is disadvantageous in that the arc is not sufficiently extinguished.

According to the present embodiment, when the pressure of the arc-extinguishing gas in the compression chamber 36 is less than the predetermined value, the check valve 42*e* becomes the opened state, and the arc-extinguishing gas is compressed in the compression chamber 36 formed by the piston 33 and the cylinder 42. When the pressure of the arc-extinguishing gas in the compression chamber 36 is equal to or larger than the predetermined value, that is, when the force to reversely move the piston 33 on the open-end direction becomes larger than the force to pull the piston by the driving device, the piston 33 starts to move reversely.

When the piston 33 starts to move reversely, the check valve 42*e* becomes the closed state. When the piston 33 moves reversely in the closed state, the pressure of the arc-extinguishing gas in the compression chamber 36 keenly decreases. Accordingly, the force to reversely move the piston 33 toward the open-end direction also keenly decreases. When the force to reversely move the piston 33 toward the open-end direction becomes smaller than the force of pulling the piston 33 by the driving device, the piston 33 starts the compression of the arc-extinguishing gas in the compression chamber 36, again.

As a result, the trigger electrode 31 is separated from the opening 62 of the insulation nozzle 23, and is separated from the opening 63 of the guide portion 41. The opening 62 and the opening 63 are opened, and is served as the exhaust passages for the arc-extinguishing gas. As a result, the arc-extinguishing gas is sprayed from the opening 61 formed between the outside of the guide portion 41 and the insulation nozzle 23, in an amount sufficient to extinguish the arc, and the arc is sufficiently extinguished.

[2-2. Effect]

According to the present embodiment, since the cylinder 42 includes the check valve 42*e* that closes between the compression chamber 36 and the pressure accumulating path 38 that guides the arc-extinguishing gas pressurized in the compression chamber 36 to the arc, the piston 33 moves reversely when the pressure of the arc-extinguishing gas in the compression chamber 36 is equal to or larger than the predetermined value, whereby the arc-extinguishing gas can be prevented from not being appropriately compressed in the compression chamber 36. Accordingly, the gas circuit breaker 1, in which the pressure and density of the arc-extinguishing gas to be sprayed to the arc can be appropriately ensured, can be provided, and the electric insulation performance of the gas circuit breaker 1 can be more surely maintained.

[3. Third Embodiment]

[3-1. Configuration and Action]

A gas circuit breaker 1 of the present embodiment further includes a smaller diameter portion 33*b* in which a piston support 33*a* with a smaller diameter is formed. Other components are identical to those in the first embodiment or the second embodiment. A configuration and action of the gas circuit breaker 1 of the present embodiment will be described with reference to FIGS. 11 and 12.

The piston 33 is driven by the columnar piston support 33*a* inserted into an insertion hole 42*a* provided in the support 43, and the piston support 33*a* includes the smaller diameter portion 33*b* which is formed to have smaller diameter in a part of the piston 33 side formed into a columnar shape. The arc-extinguishing gas flows out of a gap 71 between the smaller diameter portion 33*b* and the insertion hole 42*a*, and the gap 71 is formed in the latter half of the current breaking action by driving the piston support 33*a*.

In the current breaking action, the arc-extinguishing gas is compressed in the compression chamber 36 formed by the piston 33 and the cylinder 42. When the arc-extinguishing gas is compressed, a force to prevent the pressurization, that is, a force to reversely move the piston 33 toward the open-end direction side is generated in the compression chamber 36.

If the force to reversely move the piston 33 toward the open-end direction side becomes larger than the force to pull the piston 33 by the driving device, the piston 33 moves reversely, and the arc-extinguishing gas is not compressed.

In this case, since the piston 33 is mechanically connected to the trigger electrode 31, the trigger electrode 31 also moves reversely. This prevents the trigger electrode 31 from being separated from the opening 62 of the insulation nozzle 23, and the opening 62 is maintained in the closed state by the trigger electrode 31. In addition, the trigger electrode 31 is prevented from being separated from the opening 63 of the guide portion 41, and the opening 63 is maintained in the closed state by the trigger electrode 31. As a result, the arc-extinguishing gas in an amount sufficient to extinguish the arc is prevented from being sprayed from the opening 61 formed between the outside of the guide portion 41 and the insulation nozzle 23. When the spray amount of the arc-extinguishing gas is insufficient, it is disadvantageous in that the arc is not sufficiently extinguished.

According to the present embodiment, the smaller diameter portion 33*b* formed to have smaller diameter is provided in a part of the piston 33 side of the columnar piston support 33*a* connected to the piston 33. The arc-extinguishing gas is sprayed from the gap 71 between the smaller diameter portion 33*b* and the insertion hole 42*a* provided in the support 43 to release the excessive pressure in the compression chamber 36, thereby preventing the piston 33 from moving reversely.

Figure 11:
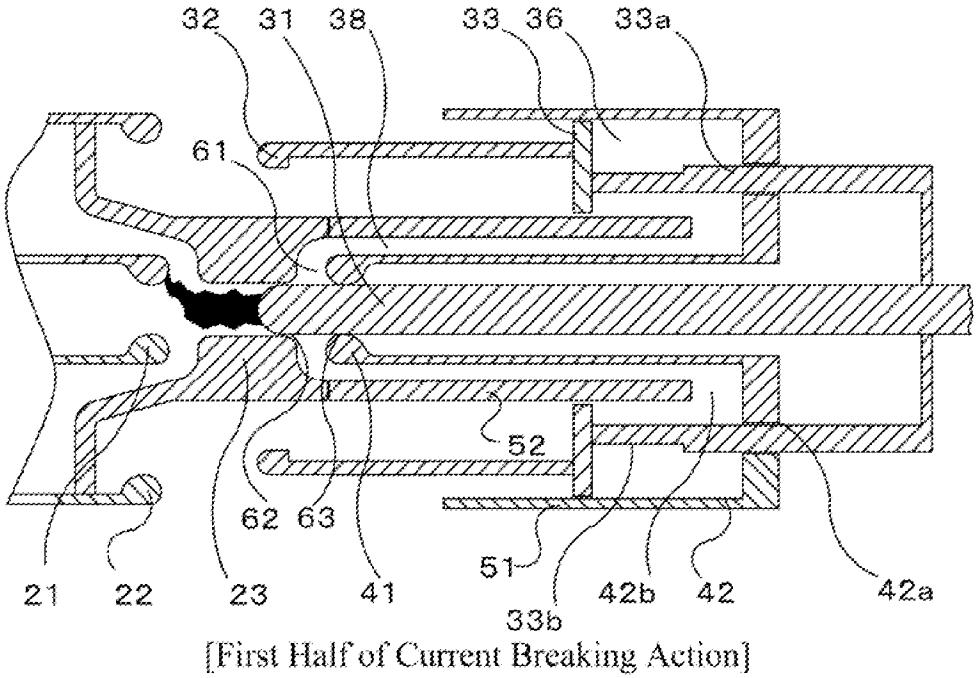
FIG. 11 is a diagram illustrating a first half of a current breaking action of a gas circuit breaker according to a third embodiment including a piston support.

As illustrated in FIG. 11, in the first half of the current breaking action, the insertion hole 42*a* provided in the support 43 is closed by the piston support 33*a*, and therefore the arc-extinguishing gas does not leak from the compression chamber 36 and the pressure accumulating path 38. In this state, the arc-extinguishing gas is compressed in the compression chamber 36 formed by the piston 33 and the cylinder 42.

Figure 12:
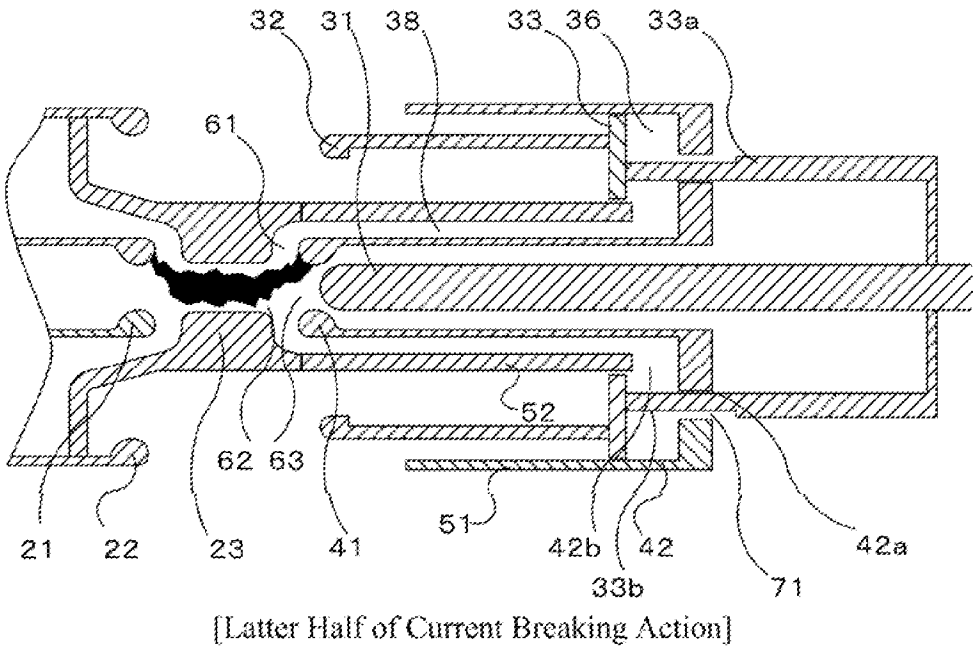
FIG. 12 is a diagram illustrating a latter half of the current breaking action of the gas circuit breaker according to the third embodiment including the piston support.

As illustrated in FIG. 12, in the latter half of the current breaking action, the smaller diameter portion 33*b* of the piston support 33*a* reaches the insertion hole 42*a*, and the gap 71 is formed. A part of the arc-extinguishing gas 1 which is excessively compressed flows out of the gap 71 to the outside of the compression chamber 36 and the pressure accumulating path 38. This prevents the pressure in the compression chamber 36 and the pressure accumulating path 38 from being excessively increased, and prevents the piston 33 from moving reversely.

The piston 33 is prevented from moving reversely, and the piston 33 compresses the arc-extinguishing gas in the compression chamber 36. As a result, the trigger electrode 31 is separated from the opening 62 of the insulation nozzle 23, and is separated from the opening 63 of the guide portion 41. The opening 62 and the opening 63 are opened, and servses as the exhaust passages for the arc-extinguishing gas. As a result, the arc-extinguishing gas is sprayed from the opening 61 formed between the outside of the guide portion 41 and the insulation nozzle 23 in an amount sufficient to extinguish the arc, and the arc is sufficiently extinguished.

[3-2. Effect]

According to the present embodiment, the piston 33 is driven by the columnar piston support 33*a* inserted into the insertion hole 42*a* provided in the support 43, and the piston support 33*a* includes the smaller diameter portion 33*b* which is formed to have smaller diameter in a part of the piston 33 side formed into a columnar shape. Since the arc-extinguishing gas flows out of the gap 71 between the smaller diameter portion 33*b* and the insertion hole 42*a*, in which the gap 71 is formed in the latter half of the current breaking action by driving the piston support 33*a*, and the piston 33 moves reversely, whereby the arc-extinguishing gas can be prevented from not being appropriately compressed in the compression chamber 36. Accordingly, the gas circuit breaker 1 in which the pressure and density of the arc-extinguishing gas to be sprayed to the arc can be appropriately ensured can be provided and the electric insulation performance of the gas circuit breaker 1 can be more surely maintained.

[4. Other Embodiments]

Although the embodiment that includes the modified example thereof has been described, such embodiment is merely presented as an example, and is not intended to limit the scope of the present embodiment. Such embodiments can be implemented in other various forms, and various omissions, replacements, and modifications can be made without departing from the scope of the present embodiment. Such embodiment and the modified form thereof are within the scope of the present embodiment and also within the scope of the invention as recited in the appended claims and the equivalent range thereto. The followings are examples thereof.

In the above-described embodiments, the arc contactor (at the movable side) 41*a* as the guide portion 41 is made of a conductive material, and in the latter half of the current breaking action, the arc is commuted from the trigger electrode 31. However, the guide portion 41 may be a rectifier 41*b* made of an insulating material.

The rectifier 41*b* is made of a material such as acrylic, polycarbonate, polystyrene, polyethylene, polypropylene, polyolefin, PTFE (polytetrafluoroethylene) resin, or a combination thereof. The above-described resin material may be filled with at least one of BN, $Al_2O_3$, ZnO, $TiO_2$, CaF, and $CeO_2$.

A ceramic material of at least one of $BaTiO_3$, $PbO_3$, $ZrO_3$, $TiO_2$, $ZrO_2$, $SiO_2$, MgO, AlN, $Si_3N_4$, SiC, and $Al_2O_3$ may be coated on a surface of the rectifier 41*b* that guides the arc-extinguishing gas to the arc discharge. Alternatively, the guide portion 41 may be made of a ceramic material of at least one of $BaTiO_3$, $PbO_3$, $ZrO_3$, $TiO_2$, $ZrO_2$, $SiO_2$, MgO, AlN, $Si_3N_4$, SiC, and $Al_2O_3$ instead of acrylic, polycarbonate, polystyrene, polyethylene, polypropylene, polyolefin, or PTFE.

Since the rectifier 41*b* is made of an insulating material, the arc is not commutated from the trigger electrode 31 to the guide portion 41. Also in the latter half of the current breaking action, the arc is in a state of being generated between the arc contactor (at the fixed side) 21 and the trigger electrode 31.

When the gas circuit breaker 1 is in the closed state and in the first half of the current breaking action, the trigger electrode 31 is inserted to close the opening 63 of the rectifier 41*b*, so that the air tightness of the arc-extinguishing gas is ensured. When the gas circuit breaker 1 is in the closed state and in the first half of the current breaking action, the trigger electrode 31 is inserted to close the opening 62 of the insulation nozzle 23, so that the air tightness of the arc-extinguishing gas is ensured.

When the gas circuit breaker 1 is in the current brake action, the trigger electrode 31 is driven by the driving device 9 to further moves in the device-end direction. In the latter half of the current breaking action, the trigger electrode 31 is separated from the opening 63 of the rectifier 41*b*, whereby the opening 63 is opened. In addition, in the latter half of the current breaking action, the trigger electrode 31 is separated from the insulation nozzle 23, and the opening 62 of the insulation nozzle 23 is opened. When the opening 62 and the opening 63 are opened, the arc-extinguishing gas pressurized in the compression chamber 36 is guided to the arc space.

The arc-extinguishing gas is sprayed at a high velocity from the opening 61 to the arc space between the arc contactor (at the fixed side) 21 and the trigger electrode 31, and the arc is extinguished.

When the opening 63 is opened, the arc-extinguishing gas guided to the arc space passes through the interior of the rectifier 41*b*, and is exhausted in the device-end direction. The rectifier 41*b* serves as the guide portion that guides the arc-extinguishing gas.

The arc-extinguishing gas passes through the opening 62 formed inside the insulation nozzle 23 and the opening 63 formed inside the rectifier 41*b* and is discharged to a large space filled with the low-pressure arc-extinguishing gas. Accordingly, the arc-extinguishing gas flows faster.

When the gas circuit breaker 1 is in the closed state and in the first half of the current breaking action, the opening 62 of the insulation nozzle 23 and the opening 63 of the rectifier 41*b* are closed by the trigger electrode 31, so that the air tightness of the arc-extinguishing gas is ensured. This can prevent the arc-extinguishing gas that has become a high temperature from entering the compression chamber 36 and the pressure accumulating passage 38. As a result, the arc-extinguishing gas is compressed at a low temperature in the compression chamber 36, whereby the pressure and density of the arc-extinguishing gas to be sprayed to the arc can be appropriately ensured.

(2) In the above-described embodiment, the fixed contactor portion 2 and the fixed contactor portion 4 are fixed to the sealed container 8, but the fixed contactor portion 2 and the fixed contactor portion 4 may be movable. When the gas circuit breaker 1 becomes the opened state, for example, the fixed contactor portion 2 may be movable in the open-end direction. In addition, the fixed contactor portion 4 may be movable in the device-end direction. When the fixed contactor portion 2 or 4, or the fixed contactor portion 2 and 4 are movable, the power between the lead-out conductors 7*a* and 7*b* can be broken more quickly.

REFERENCE SIGNS LIST

1 Gas circuit breaker
2, 4 Fixed contactor portion
3 Movable contactor portion
7*a*, 7*b* Lead-out conductor
8 Sealed container
9 Driving device
21 Arc contactor (at a fixed side)
22 Fixed conductive contactor
23 Insulation nozzle
24 Exhaust cylinder
24*a*, 24*b* Exhaust port (at an open-end side)
31 Trigger electrode
32 Movable conductive contactor
33 Piston
33*a* Piston support
33*b* Smaller diameter portion
36 Compression chamber
37 Insulation rod
38 Pressure accumulating path
41 Guide portion 41
42 Cylinder
42*a* Insertion hole
42*b* Through hole
42*e* Check valve
43 Support
44 Exhaust port (at a driving-device side)
51 Outer wall
52 Inner wall
61, 62, 63 Opening
71 Gap

The invention claimed is:

1. A gas circuit breaker, comprising:

a first arc contactor electrically connected to a first lead-out conductor connected to a power system;

a cylindrical guide portion provided at a second lead-out conductor side;

a trigger electrode which is arranged to be movable between the first arc contactor and the guide portion, and which ignites an arc generated between the first arc contactor and the trigger electrode along with a movement in a first half of a current breaking action;

a compression chamber for pressurizing arc-extinguishing gas, the compression chamber being formed by a cylinder which has an outer wall and an inner wall both formed in a cylindrical shape and which is provided on the guide portion side, and a piston which slides between the outer wall and the inner wall in conjunction with the trigger electrode;

an insulation nozzle which guides the arc-extinguishing gas pressurized in the compression chamber to an arc ignited at the first arc contactor, a first opening which is formed between an outside of the guide portion and the insulation nozzle, and which sprays the arc-extinguishing gas in a latter half of the current breaking action;

a second opening which is formed in an inner diameter of the insulation nozzle, and in which the arc-extinguishing gas is sealed by the trigger electrode in the first half of the current breaking action and is released when the trigger electrode is separated in the latter half of the current breaking action;

a third opening which is formed in an inner diameter of the guide portion, and in which the arc-extinguishing gas is sealed by the trigger electrode in the first half of the current breaking action and is released when the trigger electrode is separated in the latter half of the current breaking action;

a pressure accumulating path which has a fourth opening area and which guides the arc-extinguishing gas pressurized in the compression chamber to the arc; and a through hole which has a fifth opening area, which is provided in the inner wall of the cylinder, and which guides the arc-extinguishing gas from the compression chamber to the pressure accumulating path, wherein:

the insulation nozzle is formed integrally with the inner wall of the cylinder, the first opening has a first opening area, the second opening has a second opening area, the third opening has a third opening area, a sum of the second opening area and the third opening area is less than the first opening area, and the fifth opening area is equal to or larger than the fourth opening area, and the fourth opening area is equal to or larger than the first opening area.

2. The gas circuit breaker according to claim 1, wherein the insulation nozzle is made of an insulating material, and is supported by the inner wall of the cylinder made of a conductive material.

3. The gas circuit breaker according to claim 1, wherein the guide portion is a second arc contactor in which the arc is ignited by the trigger electrode in the latter half of the current breaking action.

4. The gas circuit breaker according to claim 1, wherein the guide portion is a rectifier made of an insulating material, which rectifies and guides the arc-extinguishing gas in a driving device direction.

5. A gas circuit breaker, comprising:

a first arc contactor electrically connected to a first lead-out conductor connected to a power system;

a cylindrical guide portion provided at a second lead-out conductor side;

a trigger electrode which is arranged to be movable between the first arc contactor and the guide portion, and which ignites an arc generated between the first arc contactor and the trigger electrode along with a movement in a first half of a current breaking action;

a compression chamber for pressurizing arc-extinguishing gas, the compression chamber being formed by a cylinder which has an outer wall and an inner wall both formed in a cylindrical shape and which is provided on the guide portion side, and a piston which slides between the outer wall and the inner wall in conjunction with the trigger electrode; and an insulation nozzle which guides the arc-extinguishing gas pressurized in the compression chamber to an arc ignited at the first arc contactor, wherein:

the insulation nozzle is formed integrally with the inner wall of the cylinder, and the cylinder includes a check valve which closes between the compression chamber and the pressure accumulating path which guides, to the arc, the arc-extinguishing gas pressurized in the compression chamber, when a pressure of the arc-extinguishing gas in the compression chamber is equal to or larger than a predetermined value.

6. The gas circuit breaker according to claim 5, wherein:

the piston is driven by a columnar piston support inserted into an insertion hole provided in a support, the piston support includes a smaller diameter portion formed to have a smaller diameter in a part of the piston side formed into a columnar shape, and the arc-extinguishing gas flows out of a gap between the smaller diameter portion and the insertion hole, the gap being formed in the latter half of the current breaking action by driving the piston support.

7. The gas circuit breaker according to claim 5, further comprising:

a first opening which is formed between an outside of the guide portion and the insulation nozzle, and which sprays the arc-extinguishing gas in a latter half of the current breaking action;

a second opening which is formed in an inner diameter of the insulation nozzle, and in which the arc-extinguishing gas is sealed by the trigger electrode in the first half of the current breaking action and is released when the trigger electrode is separated in the latter half of the current breaking action; and a third opening which is formed in an inner diameter of the guide portion, and in which the arc-extinguishing gas is sealed by the trigger electrode in the first half of the current breaking action and is released when the trigger electrode is separated in the latter half of the current breaking action.

8. The gas circuit breaker according to claim 7, wherein the first opening has a first opening area, the second opening has a second opening area, the third opening has a third opening area, and a sum of the second opening area and the third opening area is less than the first opening area.

9. The gas circuit breaker according to claim 8, further comprising:

a pressure accumulating path which has a fourth opening area and which guides the arc-extinguishing gas pressurized in the compression chamber to the arc; and a through hole which has a fifth opening area, which is provided in the inner wall of the cylinder, and which guides the arc-extinguishing gas from the compression chamber to the pressure accumulating path, wherein the fifth opening area is equal to or larger than the fourth opening area, and the fourth opening area is equal to or larger than the first opening area.

10. A gas circuit breaker, comprising:

a first arc contactor electrically connected to a first lead-out conductor connected to a power system;

a cylindrical guide portion provided at a second lead-out conductor side;

a trigger electrode which is arranged to be movable between the first arc contactor and the guide portion, and which ignites an arc generated between the first arc contactor and the trigger electrode along with a movement in a first half of a current breaking action;

a compression chamber for pressurizing arc-extinguishing gas, the compression chamber being formed by a cylinder which has an outer wall and an inner wall both formed in a cylindrical shape and which is provided on the guide portion side, and a piston which slides between the outer wall and the inner wall in conjunction with the trigger electrode; and an insulation nozzle which guides the arc-extinguishing gas pressurized in the compression chamber to an arc ignited at the first arc contactor, wherein:

the insulation nozzle is formed integrally with the inner wall of the cylinder, the piston is driven by a columnar piston support inserted into an insertion hole provided in a support, the piston support includes a smaller diameter portion formed to have a smaller diameter in a part of the piston side formed into a columnar shape, and the arc-extinguishing gas flows out of a gap between the smaller diameter portion and the insertion hole, the gap being formed in the latter half of the current breaking action by driving the piston support.

* * * * *